US007231796B1

(12) United States Patent
Chuang

(10) Patent No.: US 7,231,796 B1
(45) Date of Patent: Jun. 19, 2007

(54) STRUCTURE OF ROLL-FORMING MACHINE

(76) Inventor: Sen-Jung Chuang, No. 90-10, Hsia Kwei Jou San, Tan Shui Chen, Taipei County (TW)

( * ) Notice: Subject to any disclaimer, the term of this patent is extended or adjusted under 35 U.S.C. 154(b) by 153 days.

(21) Appl. No.: 11/038,073

(22) Filed: Jan. 21, 2005

(51) Int. Cl.
*B21D 5/08* (2006.01)

(52) U.S. Cl. ..... 72/181; 72/226

(58) Field of Classification Search ..... 72/181, 72/176, 226
See application file for complete search history.

(56) References Cited

U.S. PATENT DOCUMENTS 1,673,787 A * 6/1928 Frahm et al. ..... 72/178
2,843,178 A * 7/1958 Nighthart ..... 72/113
4,787,232 A * 11/1988 Hayes ..... 72/176
5,722,278 A * 3/1998 Horino et al. ..... 72/8.3
5,787,748 A * 8/1998 Knudson et al. ..... 72/181
6,216,514 B1 * 4/2001 Bradbury et al. ..... 72/178
6,772,616 B2 * 8/2004 Cunningham et al. ..... 72/181

* cited by examiner

*Primary Examiner*—Daniel C. Crane
(74) *Attorney, Agent, or Firm*—Troxell Law Office, PLLC

(57) ABSTRACT

A roll-forming machine formed of a machine base, a plurality of sheet-transfer roll sets, and a plurality of forming roll sets and adapted for the formation of a C-shaped component or a Z-shaped component from a sheet material is disclosed to have an adjustment structure for adjusting the horizontal pitch between the left-side forming rolls and the right-side forming rolls, the vertical pitch between the first left-side forming toll and the second left-side and the vertical pitch between the first right-side forming roll and the second right-side forming roll, and the pitch between the impression roll and sheet-transfer roll of each sheet-transfer roll set.

7 Claims, 29 Drawing Sheets

STRUCTURE OF ROLL-FORMING MACHINE

BACKGROUND AND SUMMARY OF THE INVENTION

The present invention relates to a roll-forming machine and more particularly, to an improved structure of roll-forming machine, which is adjustable to fit different thickness of sheet materials for the formation of a C-shaped component or a Z-shaped selectively.

Many roll-forming machines are known and used to transform a planar sheet of metal into a component having either a C-shaped or Z-shaped cross-sectional area. U.S. Pat. No. 6,216,514 B1 is a typical one of these designs. This design, as shown in FIG. 1, is still not satisfactory in function because of the following drawbacks:

1. When forming rolls 91, 92 or transferring rolls 931, 932, 941, 942 start to wear or other related component parts are damaged, locating members 951, 952, gears 961, 962, axle sleeve means 971, 972, 973, 974 and shaft members 981, 982 must be detached, so that the repair or replacement work can be started. After the repair or replacement work, the detached component parts must be installed again, i.e., much labor and time are wasted during a repair or replacement work.
2. The left-side and right-side telescoping arbor assemblies 991, 992 that support the forming rolls 91, 92 are adjustable so that the lateral distance between the forming rolls 91, 92 may be adjusted. However, the forming rolls 91, 92 are not adjustable vertically to fit sheet materials of different thickness to facilitate the formation of C-shaped components/Z-shaped components of different specifications.

The present invention has been accomplished under the circumstances in view. It is therefore the main object of the present invention to provide a roll-forming machine, which eliminates the aforesaid drawbacks.

According to one aspect of the present invention, the roll-forming machine comprises a machine base, a plurality of sheet-transfer roll sets, a plurality of forming roll sets and adapted for the formation of a C-shaped component or a Z-shaped component from a sheet material, and an adjustment structure for adjusting the horizontal pitch between the left-side forming rolls and the right-side forming rolls, the vertical pitch between the first left-side forming toll and the second left-side and the vertical pitch between the first right-side forming roll and the second right-side forming roll, and the pitch between the impression roll and sheet-transfer roll of each sheet-transfer roll set. According to another aspect of the present invention, the sheet-transfer roll sets and the plurality of forming roll sets are conveniently detachable from the machine base for a maintenance or repair work. According to still anther aspect of the present invention, the left-side wheel holder and right-side wheel holder of each forming roll set each have a wheel bracket pivotally secured thereto by a respective pivot shaft. The pivot shaft at the left-side wheel holder of each forming roll set is rotatable by a motor through 180° to reverse the relative position between the first left-side forming roll and the second left-side forming roll, for enabling the forming rolls of each forming roll set to roll a sheet material into a C-shaped component or a Z-shaped component selectively.

DETAILED DESCRIPTION OF THE INVENTION

Figure 1:
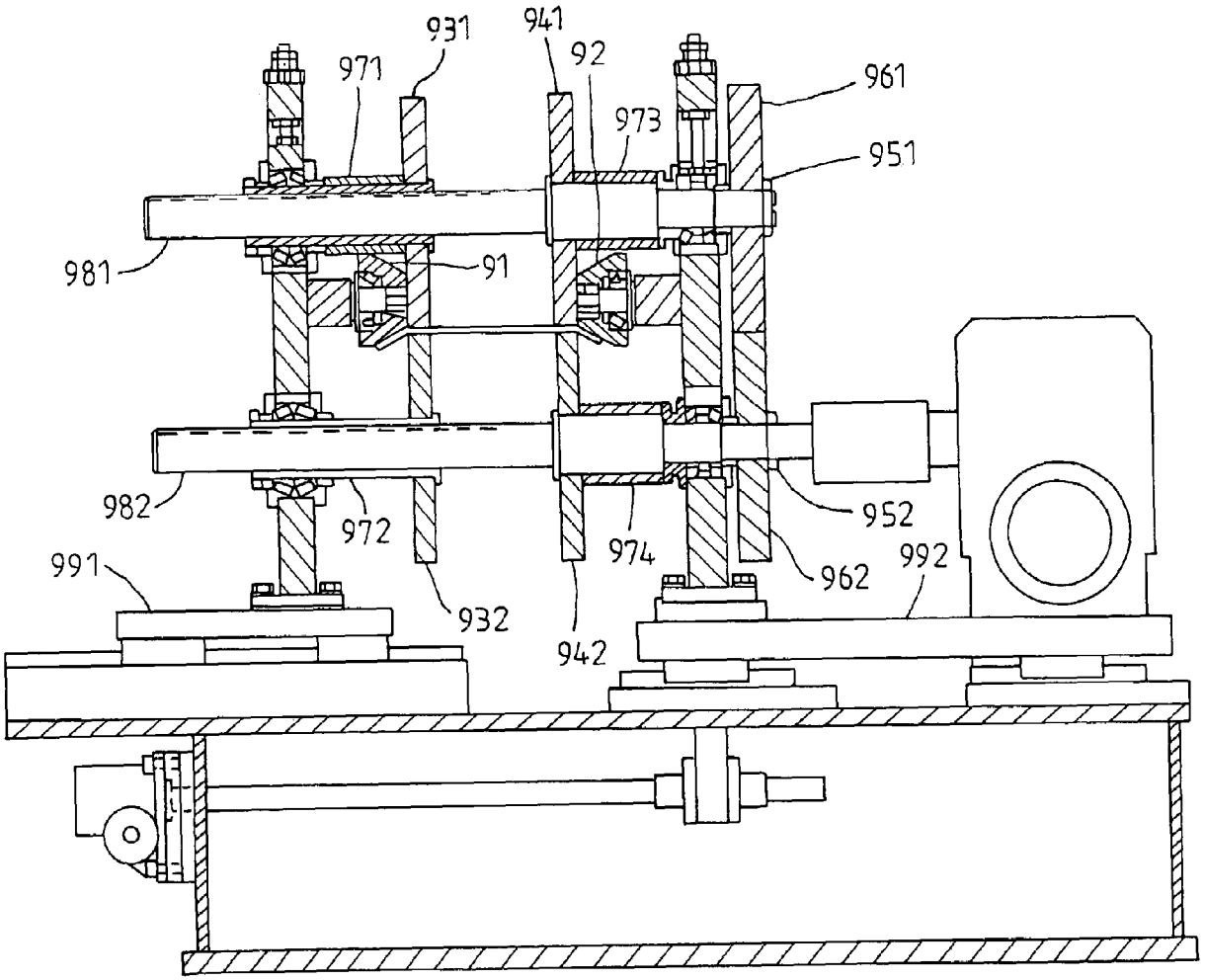
Fig. 1 PRIOR ART
FIG. 1 is a plain view of a roll-forming machine according to the prior art.

Referring to FIGS. 2~39, a roll-forming machine in accordance with the present invention is shown adapted to facilitate the formation of either a C-shaped component or a Z-shaped component selectively from a sheet of material. The roll-forming machine comprises a plurality of sheet-transfer roll sets 3, and a plurality of forming roll sets 4.

The sheet-transfer roll sets 3 each comprise a left-side support 31 and a right-side support 34 arranged in parallel, a first axle 33 and a second axle 36 horizontally pivotally connected between the left-side support 31 and the right-side support 34 at different elevations, an impression roll 32 fixedly mounted on the first axle 33, a sheet-transfer roll 35 fixedly mounted on the second axle 36 with the periphery thereof set in proximity to the periphery of the impression roll 32 (see FIG. 3), a first gear wheel 331 fixedly mounted on the first axle 33, a second gear wheel 361 fixedly mounted on the second axle 36 and meshed with the first gear wheel 331, a reduction gear box 37, and a coupling 370 coupled between the output end of the reduction gear box 37 and one end of the second axle 36. Further, a motor 38 is coupled to the input end of the reduction gear box 37 of one sheet-transfer roll set 3 and adapted to drive the reduction gear box 37 of each sheet-transfer roll set 3 to rotate the second axles 36 of the sheet-transfer roll sets 3, causing the impression rolls 32 and sheet-transfer rolls 35 of each sheet-transfer roll set 3 to be rotated relative to each other in reversed directions to transfer a sheet material.

The forming roll sets 4 (see FIGS. 9~28) each comprise a left-side wheel holder 41, a right-side wheel holder 43, a first left-side forming roll 421 and a second left-side forming roll 422 pivotally mounted on the left-side wheel holder 41 at different elevations, and a first right-side forming roll 431 and a second right-side forming roll 432 pivotally mounted on the right-side wheel holder 43 at different elevations corresponding to the first left-side forming roll 421 and the second left-side forming roll 422. The forming rolls 421, 422, 431, 432 have different shapes. These forming roll sets 4 have the same structure and therefore the same reference sign references them.

When a sheet material 80 (see FIG. 9) passed over a guide block unit 1 to the machine base 2, it is immediately transferred in proper order through the impression roll 32 and sheet-transfer roll 35 of each of the sheet-transfer roll sets 3, and then rolled in proper order by the forming rolls 421, 422, 431, 432 of each of the forming roll sets 4 into a C-shaped component 81 (see FIGS. 9~22). When the operator turned the left-side wheel holder 41 vertically through 180° to reverse the relative position between the first left-side forming roll 421 and the second left-side forming roll 422 (see FIG. 29), the forming rolls 421, 422, 431, 432 of the forming roll sets 4 are set to roll a sheet material (see FIGS. 32 and 36) into a Z-shaped component (see FIG. 30).

The main features of the present invention are outlined hereinafter.

The left-side support 31 and the right-side support 34 of each sheet-transfer roll set 3 are respectively fixedly fastened to the machine base at the left and right sides (see FIGS. 6~8 and FIG. 31). The left-side wheel holder 41 and right-side wheel holder 43 of each forming roll set 4 are respectively fastened to a first left-side bottom plate 61, a first right-side bottom plate 62, a second left-side bottom plate 63 and a second right-side bottom plate 64 at the top. The first left-side bottom plate 61 and the first right-side bottom plate 62 have sliding blocks 611, 621 provided at the bottom side and respectively coupled to a first left-side rail 21 and a first right-side rail 22 at the machine base 2. The second left-side bottom plate 63 and the second right-side bottom plate 64 have sliding blocks 631, 641 provided at the bottom side and respectively coupled to a second left-side rail 23 and a second right-side rail 24 at the machine base 2. When the forming rolls 421, 422, 431, 432 of the forming roll sets 4 start to wear, or the related bearings or other parts are damaged and a maintenance or repair work is necessary, the related fastening members 50 (see FIGS. 4, 33 and 36) can conveniently removed from the forming roll sets 4.

The left-side wheel holder 41 and right-side wheel holder 43 of each forming roll set 4 each have a wheel bracket 46 or 47 pivotally secured thereto by a respective pivot shaft 44

Figure 32:
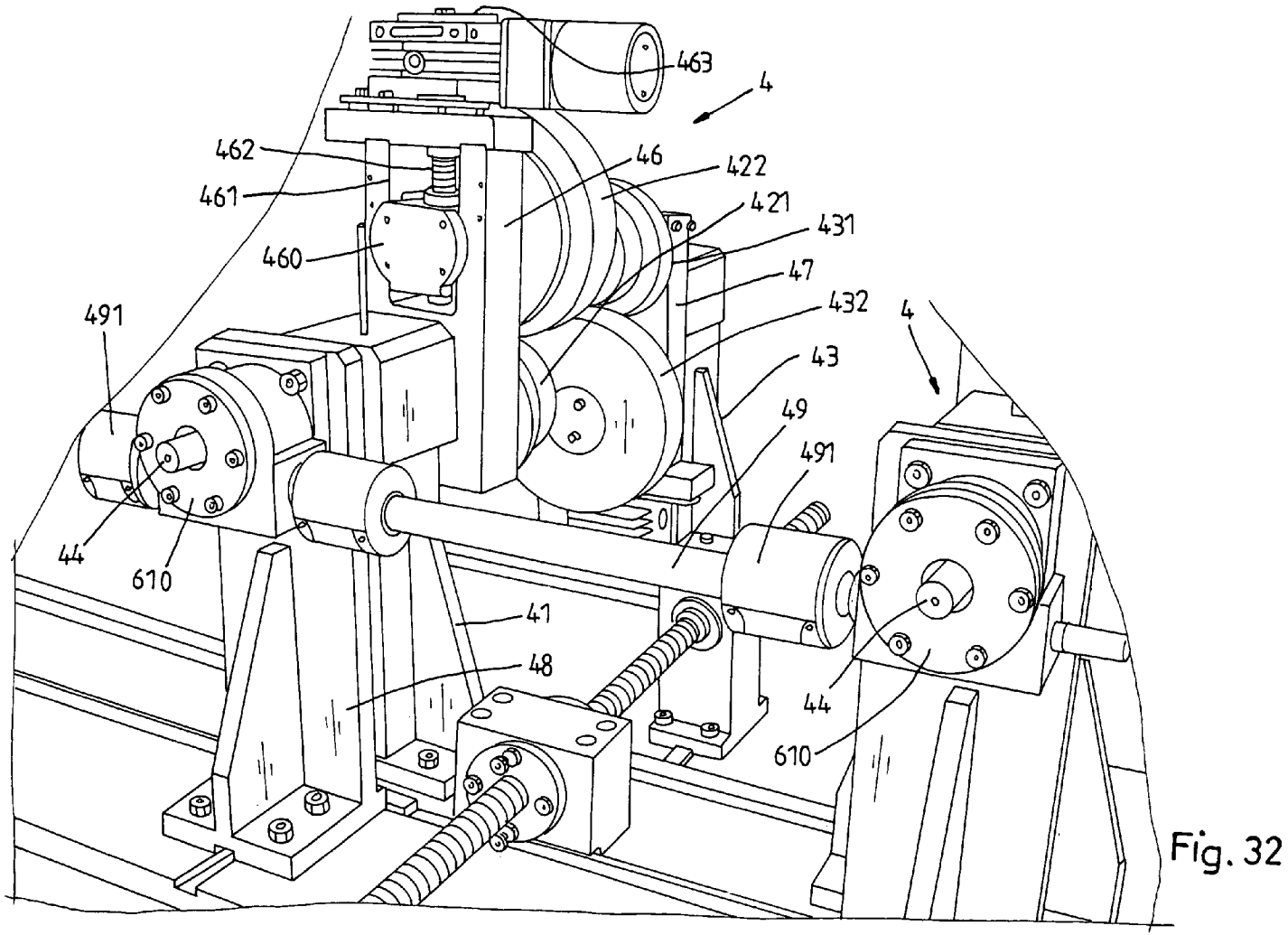
FIG. 32 is a perspective view in an enlarged scale of a part of the present invention, showing the status of one forming roll set after rotation of the pivot shaft at the left-side wheel holder of the respective forming roll set rotated through 180°.
Figure 33:
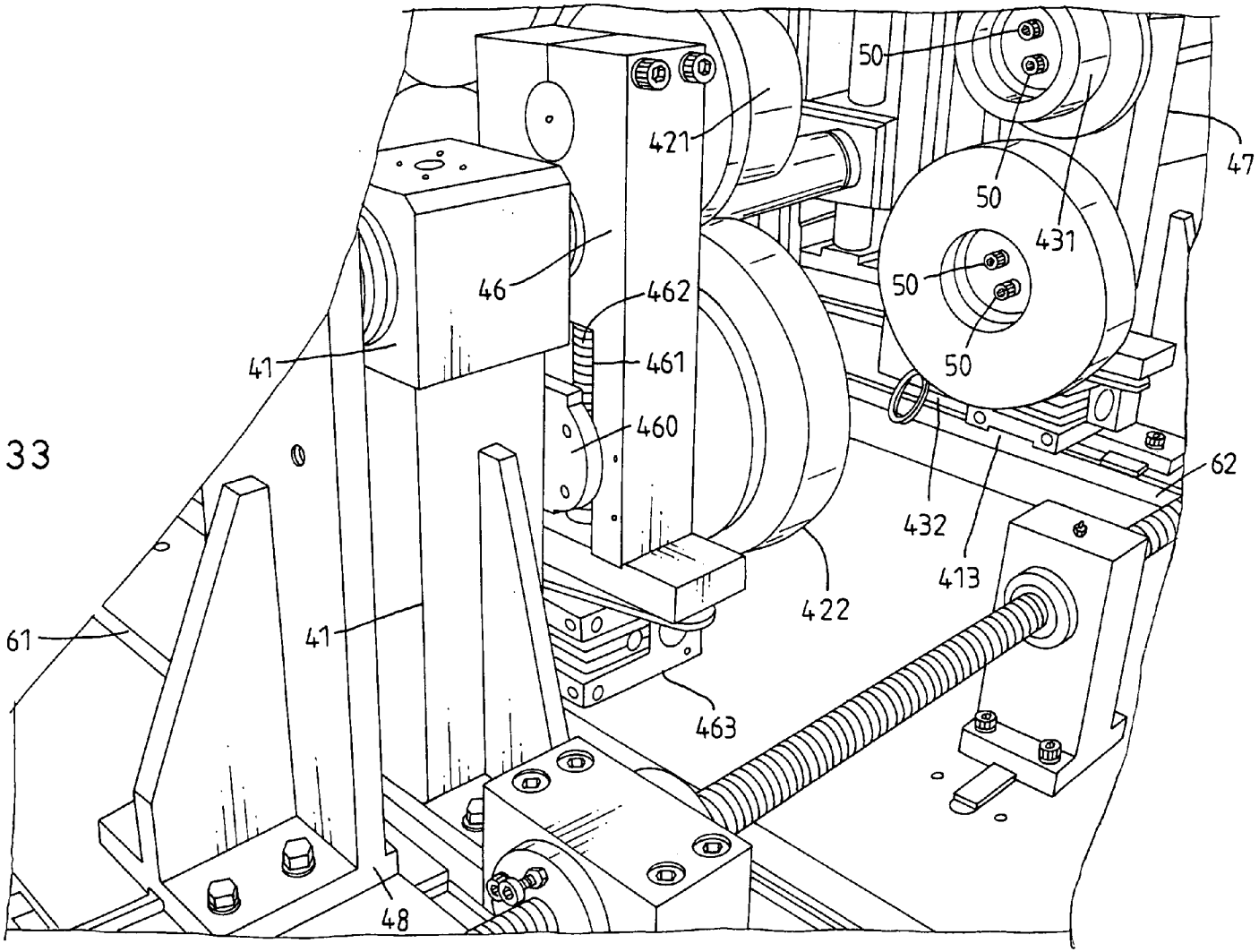
FIG. 33 is a perspective view in an enlarged scale of another part of the roll-forming machine according to the present invention.
Figure 34:
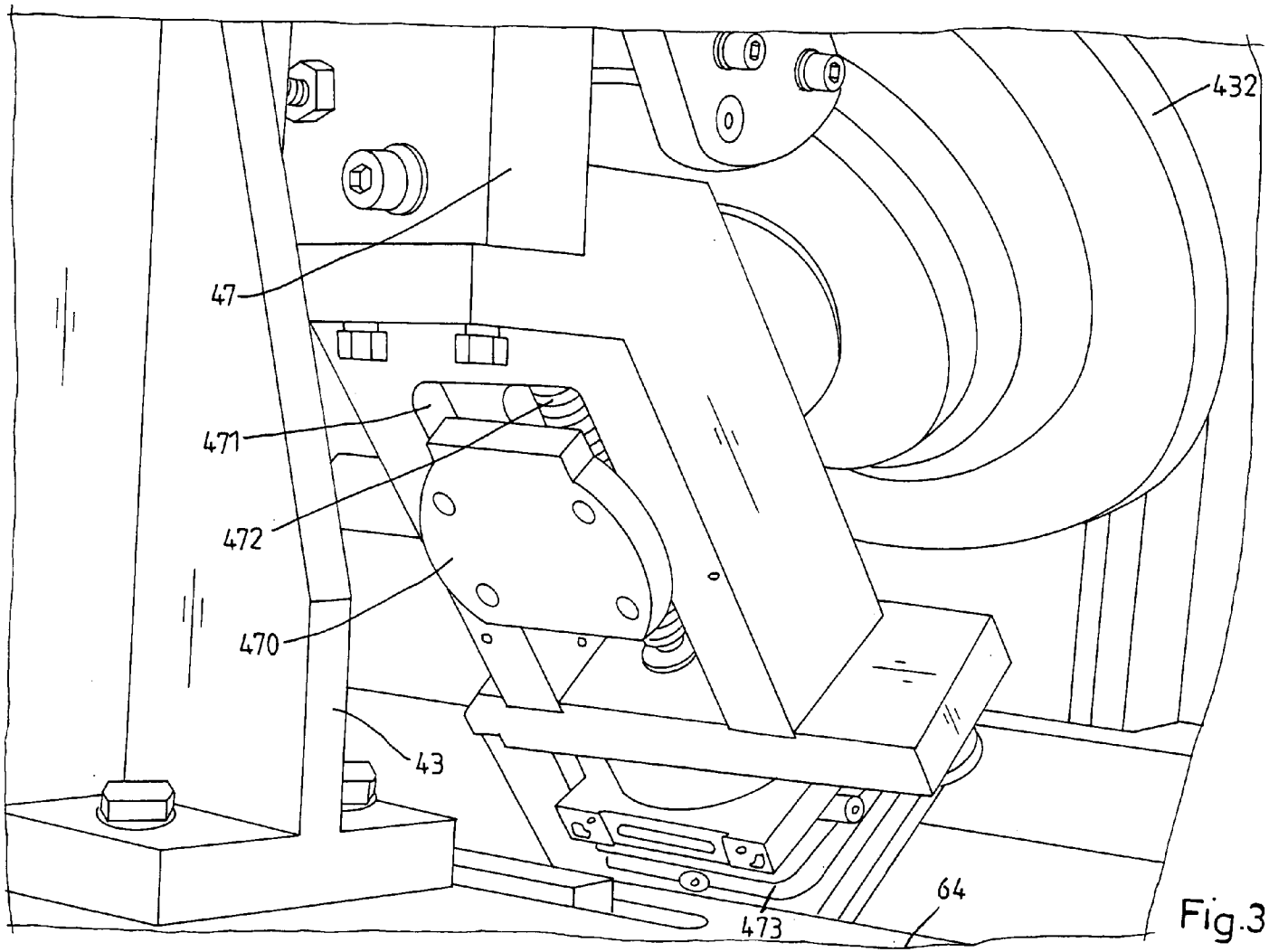
FIG. 34 is a perspective view in an enlarged scale of a part of one forming roll set of the roll-forming machine according to the present invention.
Figure 36:
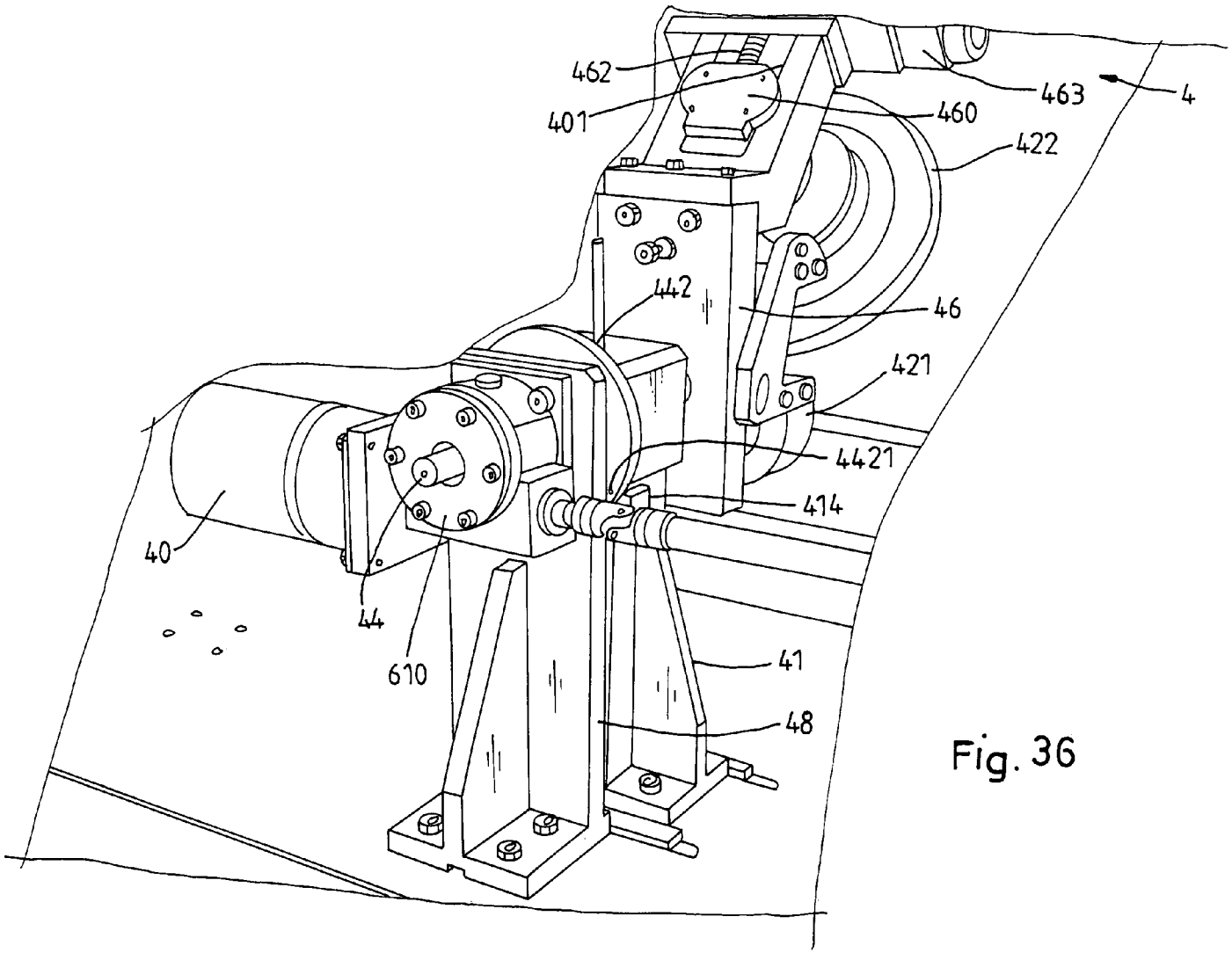
FIG. 36 is a perspective view in an enlarged scale of a part of the present invention, showing the status of one forming roll set after rotation of the pivot shaft at the left-side wheel holder of the respective forming roll set rotated through 180°.

(see FIGS. 32 and 36). The first left-side forming roll 421 and first right-side forming roll 431 of each forming roll set 4 are respectively pivoted to the wheel brackets 46, 47 of the respective forming roll set 4. The wheel brackets 46, 47 each have a sliding groove 461 or 471 (see FIGS. 33 and 34). The second left-side forming roll 422 and second right-side forming roll 432 of each forming roll set 4 are respectively pivotally mounted on sliding blocks 460, 470 that are respectively slidably coupled to the sliding grooves 461, 471 of the wheel brackets 46, 47 of the respective forming roll set 4. Each forming roll set 4 further comprises two screw rods 462, 472 respectively threaded through the wheel brackets 46, 47 thereof, and two speed-reduction motors 463, 473 adapted to rotate the screw rods 462, 472 and to further move the sliding blocks 460, 470 vertically along the sliding grooves 461, 471 of the respective wheel brackets 46, 47, so as adjust the pitch between the first left-side forming roll 421 and the second right-side forming roll 422 and the pitch between the first right-side forming roll 431 and the second right-side forming roll 432.

Figure 37:
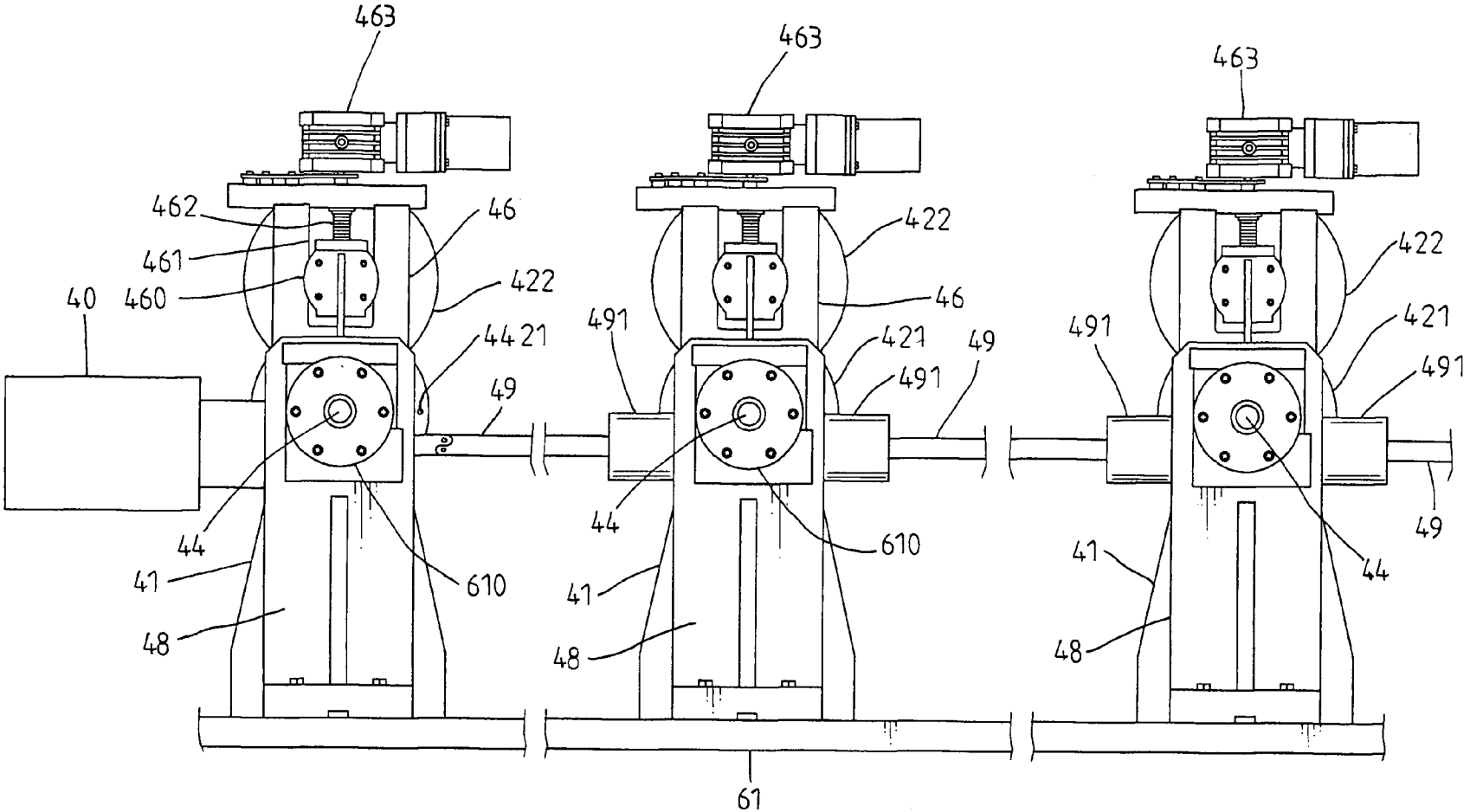
FIG. 37 is a schematic plain view showing connection among the parts at the first left-side bottom plates according to the present invention.
Figure 38:
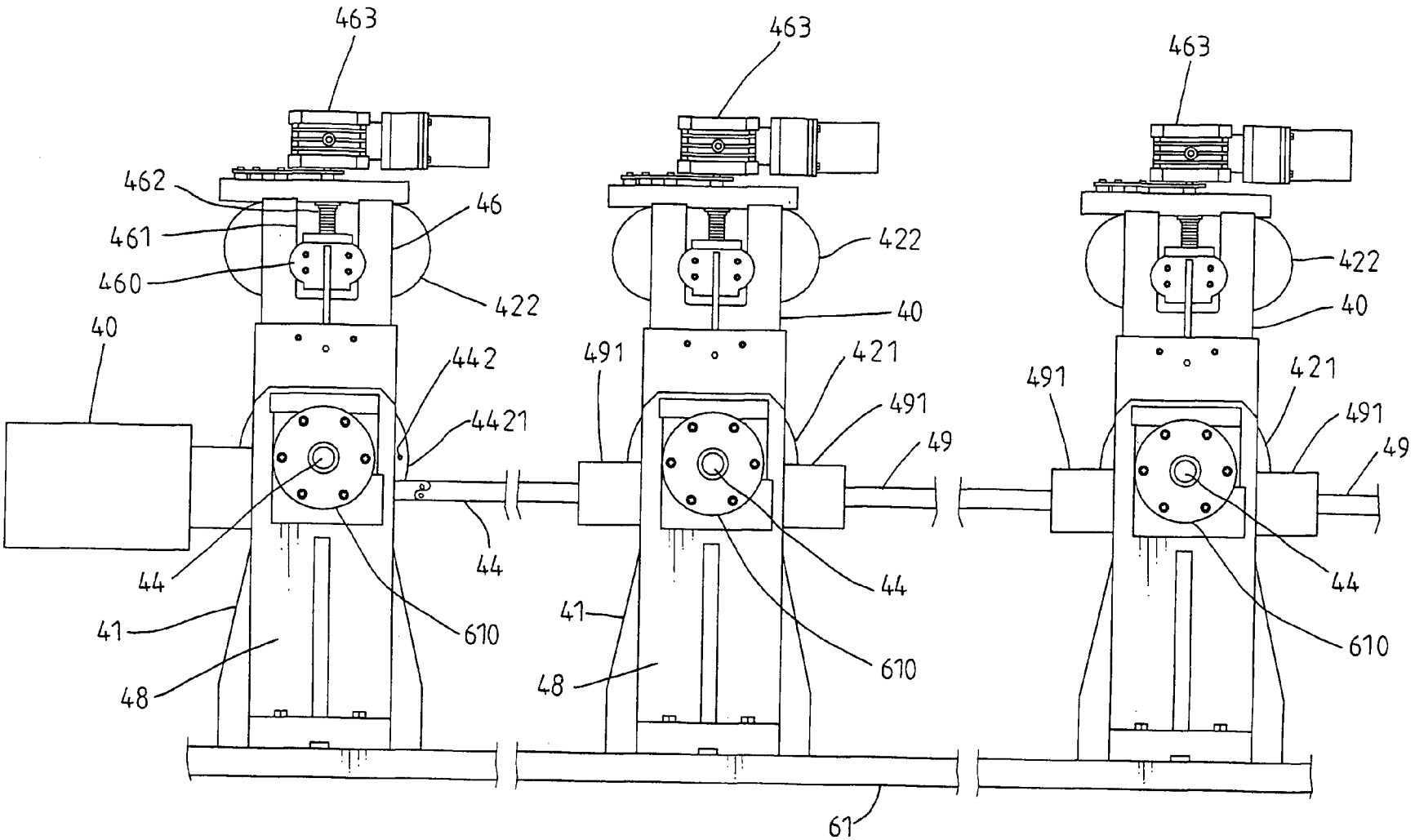
FIG. 38 is a schematic plain view showing connection among the parts at the second left-side bottom plates according to the present invention.
Figure 39:
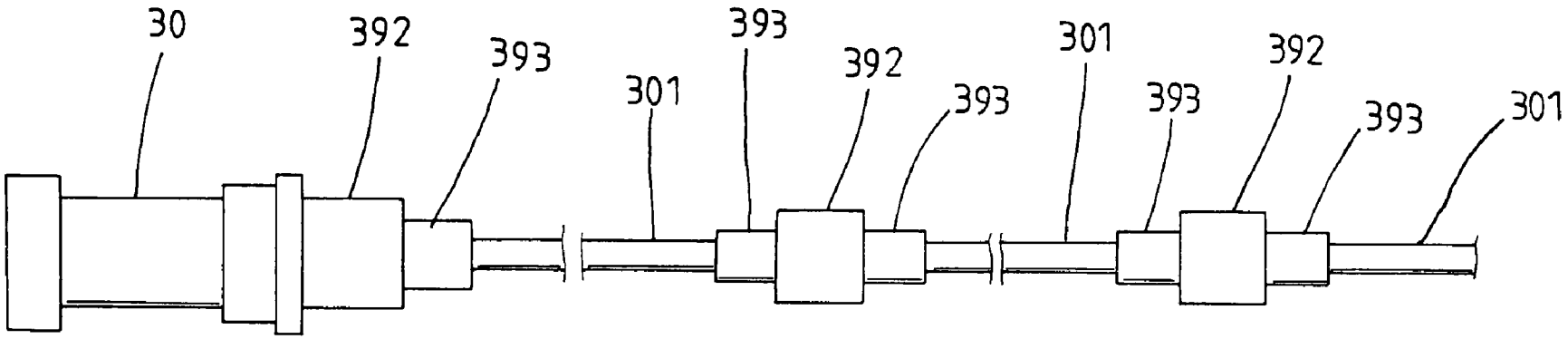
FIG. 39 is a schematic plain view showing the connection among the steering devices and the transmission shafts of the sheet-transfer roll sets according to the present invention.

Referring to FIGS. 32, 37 and 38, the pivot shaft 44 at the left-side wheel holder 41 of each forming roll set 4 has an outer end connected to a steering device 610, which is mounted on an upright 48 at the first left-side bottom plate 61 of the respective forming roll set 4. The steering devices 610 of the forming roll sets 4 are coupled to transmission shafts 49 and then a motor 40 by couplings 491. The motor 40 is rotated to rotate the transmission shafts 49 and the couplings 491, driving the pivot shaft 44 at the left-side wheel holder 41 of each forming roll set 4 to turn the wheel brackets 46 at the left-side wheel holders 41 of the forming roll sets 4 through 180°. When turned the wheel brackets 46 at the left-side wheel holders 41 through 180°, the relative position between the first left-side forming roll 421 and the second left-side forming roll 422 of each forming roll set 4 is reversed, and therefore the forming rolls 421, 422, 431, 432 of the forming roll sets 4 are set to roll a sheet material into a Z-shaped component. Further, a detection wheel 442 (see FIGS. 6 and 7) is fastened to the pivot shaft 44 at the left-side wheel holder 41 of one forming roll set 4. The detection wheel 442 has through holes 4421 equiangularly spaced around the border area. A photo sensor module 414 is installed in the respective left-side wheel holder 41 to emit light toward the through holes 4421 so as to detect the amount of rotation of the detection wheel 442 with the respective pivot shaft 44. When the pivot shaft 44 turned to the desired angle, the photo sensor module 414 immediately outputs a signal to stop the motor 40, holding the wheel brackets 46 in the desired position.

Figure 35:
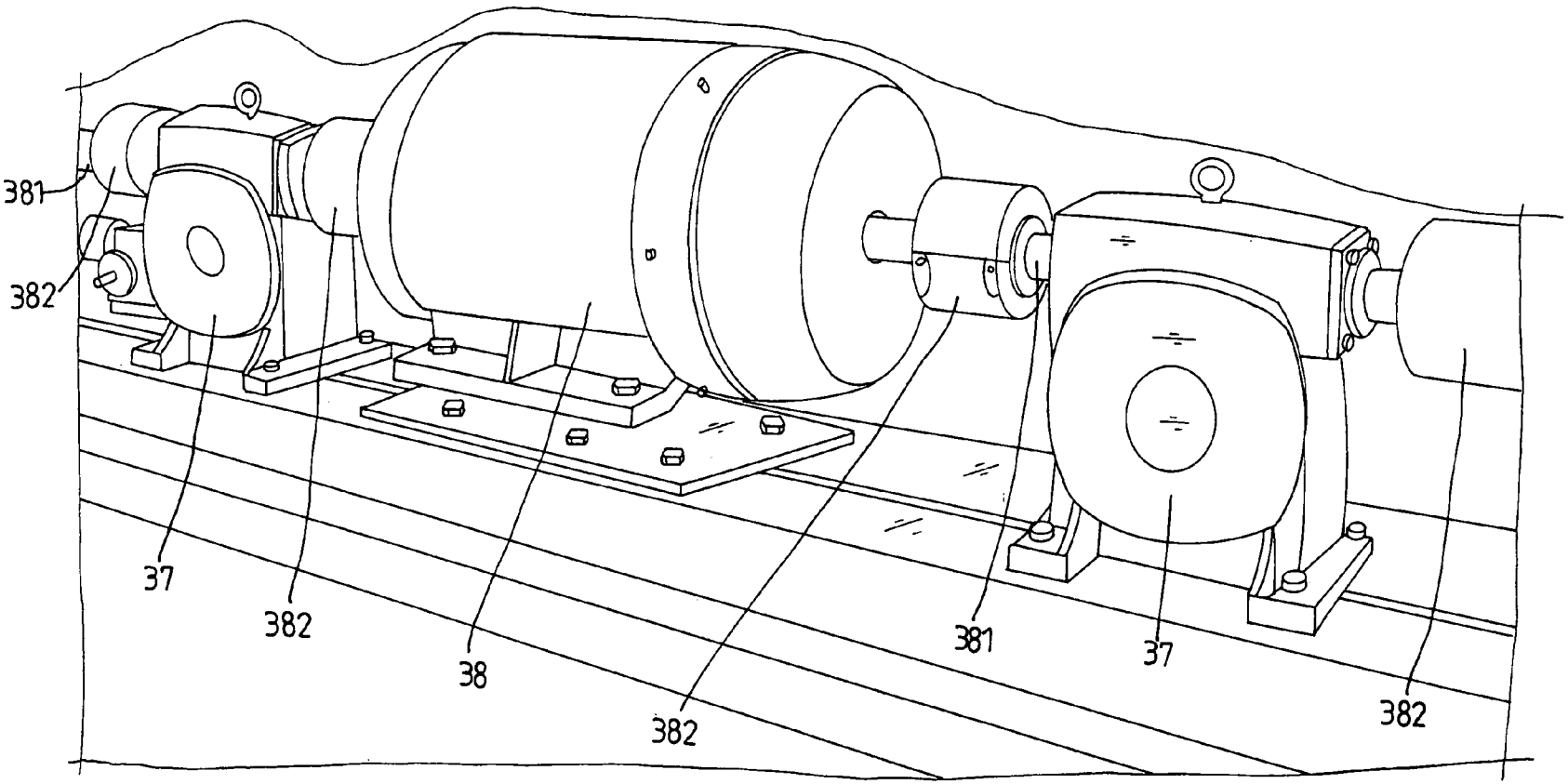
FIG. 35 is a perspective view in an enlarged scale of a part of one sheet-transfer roll set of the roll-forming machine according to the present invention.

Referring to FIG. 35, the motor 38 of each sheet-transfer roll sets 3 is mounted on the machine base 2 near one lateral side and connected to the reduction gear boxes 37 of the sheet-transfer roll sets 3 by transmission shafts 381 and couplings 382 and adapted to drive the reduction gear boxes 37 to rotate the respective second axles 36 through the respective couplings 370.

The first left-side bottom plate 61 that holds the left-side wheel holder 41 of the respective forming roll set 4 comprises a plurality of fixed guide blocks 614, and a plurality of screw rods 615 respectively threaded through the fixed guide blocks 614. The screw rods 615 each have one end threaded into a bearing block 617 at the machine base 2 and the other end coupled to a speed reduction motor 616 on a motor mount 618 at the machine base 2. When started the motor 616, the first lefts-side bottom plate 61 is forced by the screw rods 615 to move along the respective first left-side rail 21.

The second left-side bottom plate 63 and second right-side bottom plate 64 of each sheet-transfer roll set 3 each have a plurality of fixed guide blocks 633, 644. Screw rods 60 are respectively threaded through the fixed guide blocks 643 at the second left-side bottom plate 63 and the fixed guide blocks 634 at the second right-side bottom plate 64. The screw rods 60 each have one end threaded into a bearing block 600 at the machine base 2 and the other end coupled to a respective steering device 605 on a support 619 at the machine base 2. The steering devices 605 of the sheet-transfer roll sets 3 are respectively connected to one another by transmission shafts 601. Further, a motor 6051 is coupled to one steering device 605. When started the motor 6051, the steering devices 605 are driven to rotate the transmission shafts 601 and the screw rods 60, thereby causing the second left-side bottom plates 63 of the sheet-transfer roll sets 3 to be moved relative to the respective second right-side bottom plates 64, and therefore the pitch between the second left-side bottom plate 63 and the respective second right-side plates 64 is relatively adjusted.

Figure 2:
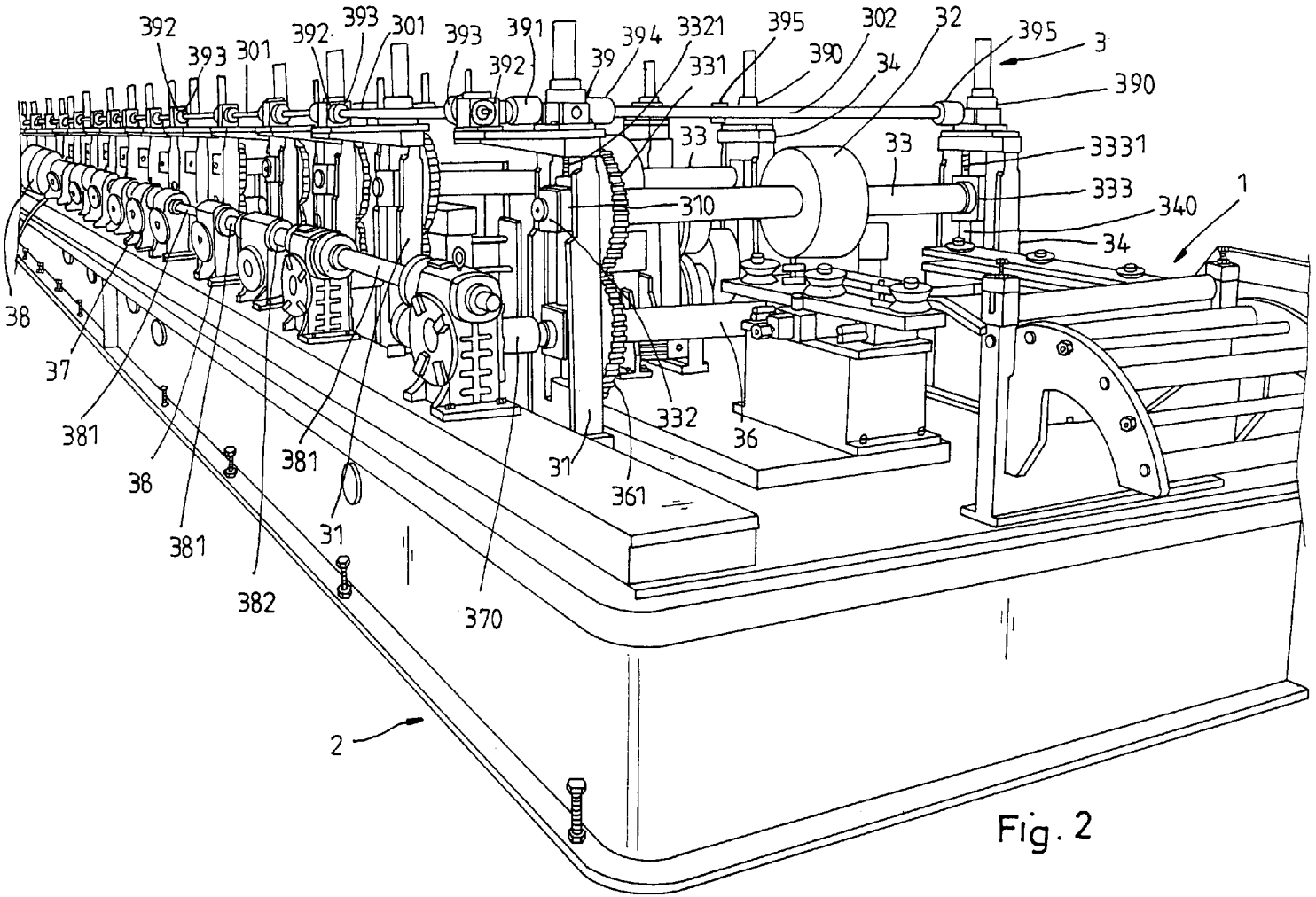
FIG. 2 is an oblique elevation of a roll-forming machine according to the present invention.
Figure 3:
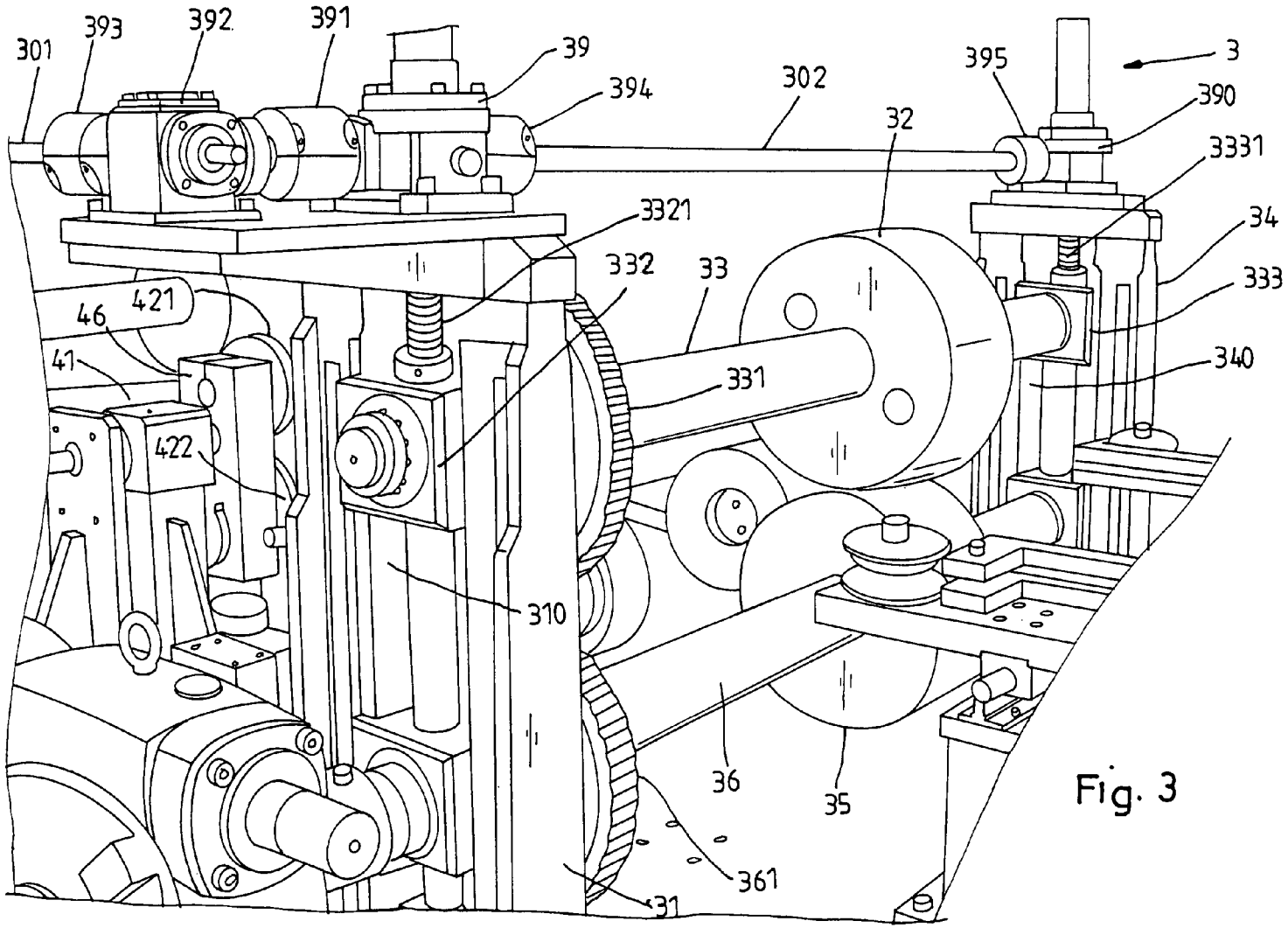
FIG. 3 is an enlarged view of a part of the roll-forming machine according to the present invention.
Figure 4:
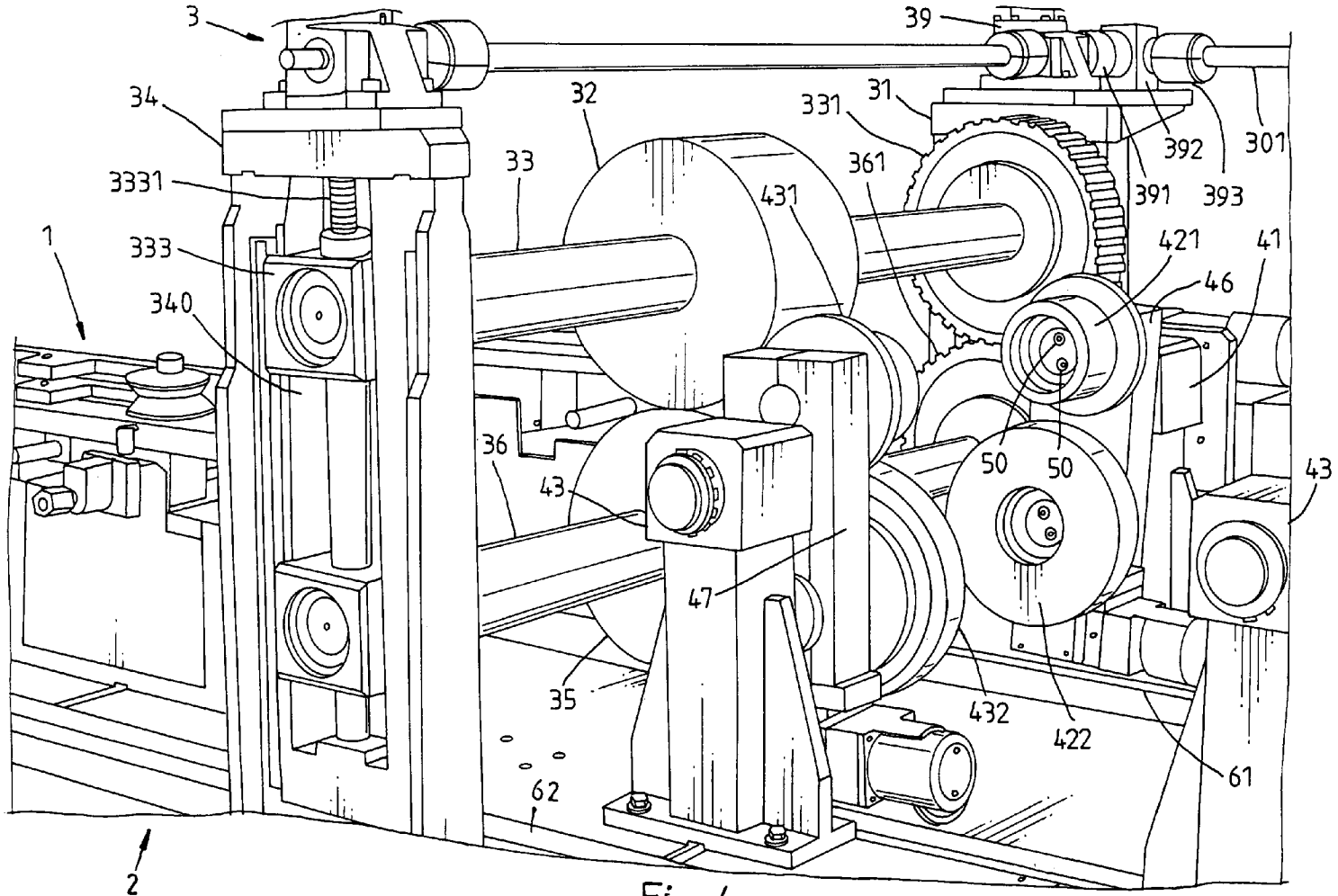
FIG. 4 is an enlarged view of another part of the roll-forming machine according to the present invention.
Figure 5:
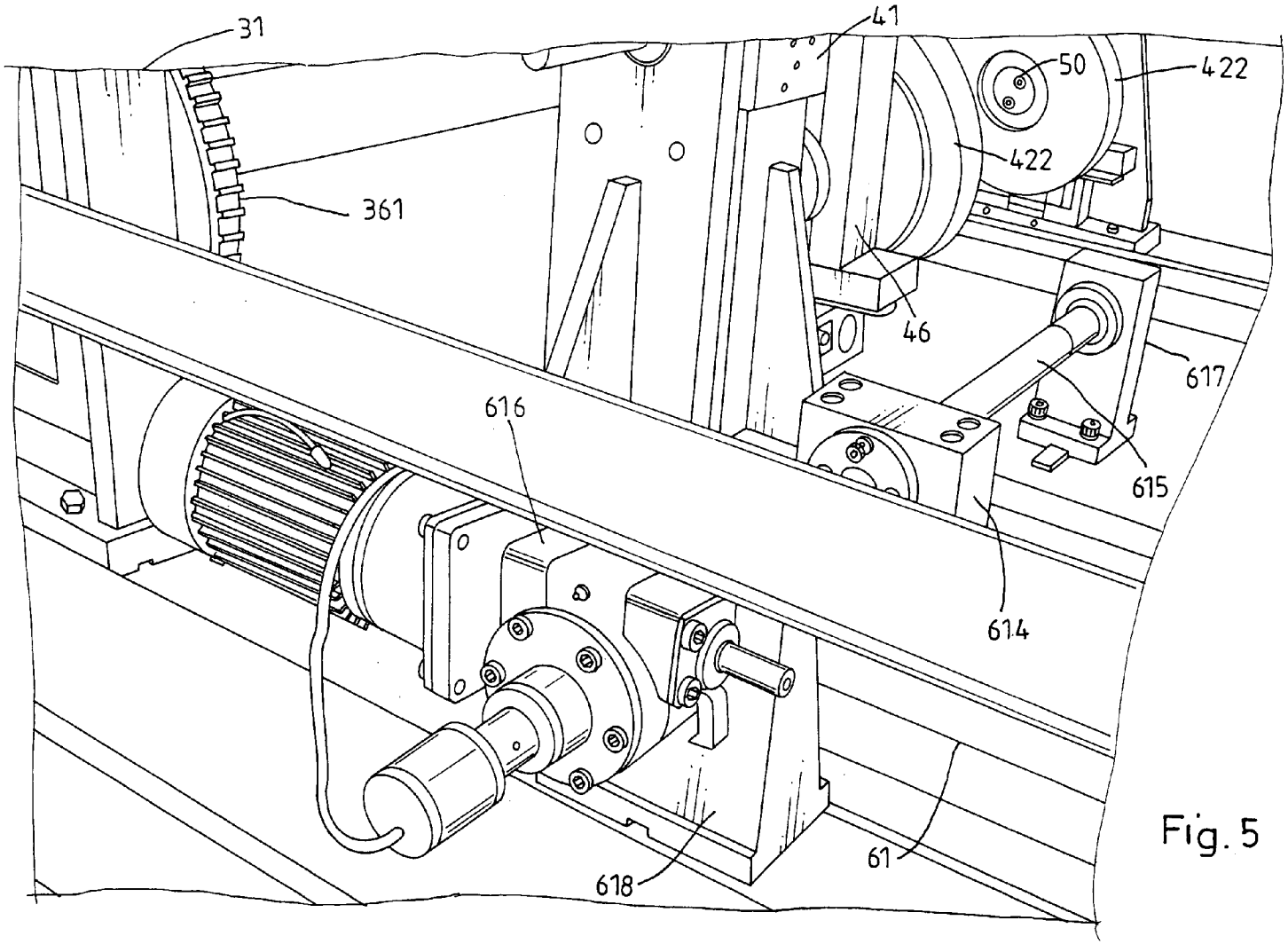
FIG. 5 is an enlarged view of still another part of the roll-forming machine according to the present invention.
Figure 6:
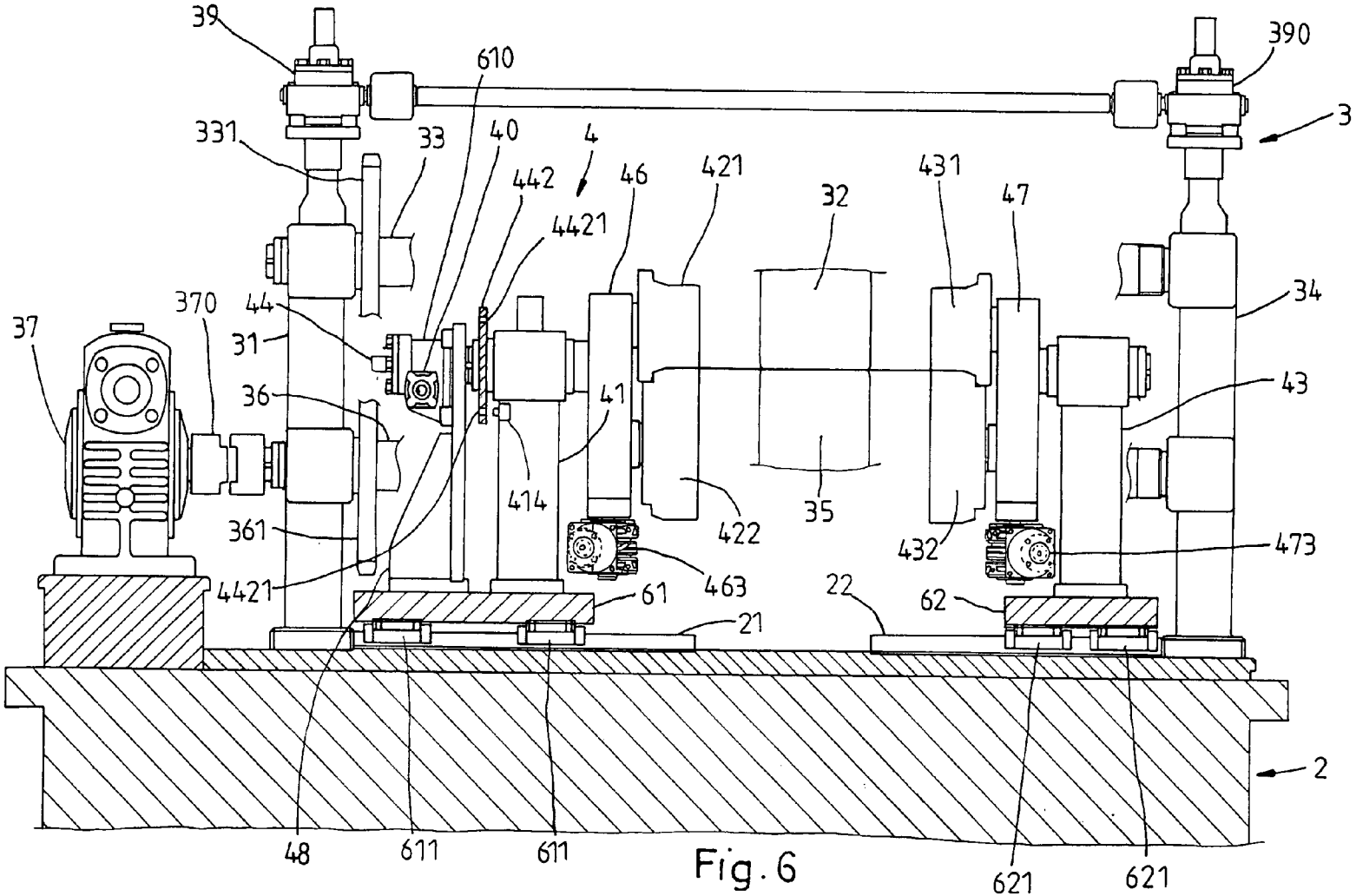
FIG. 6 is a schematic sectional view of a part of the roll-forming machine according to the present invention.
Figure 7:
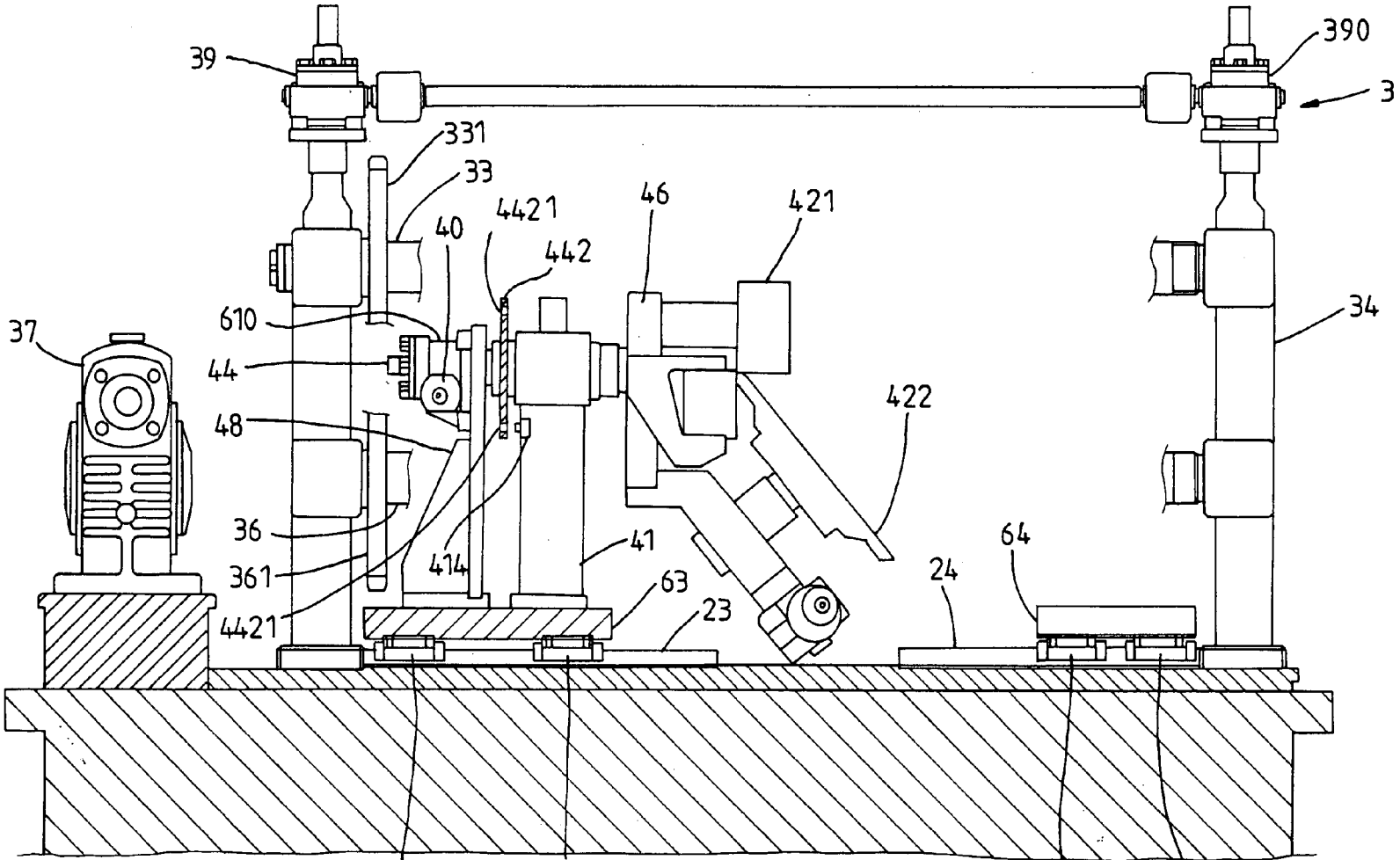
FIG. 7 is a schematic sectional view of another part of the roll-forming machine according to the present invention.
Figure 8:
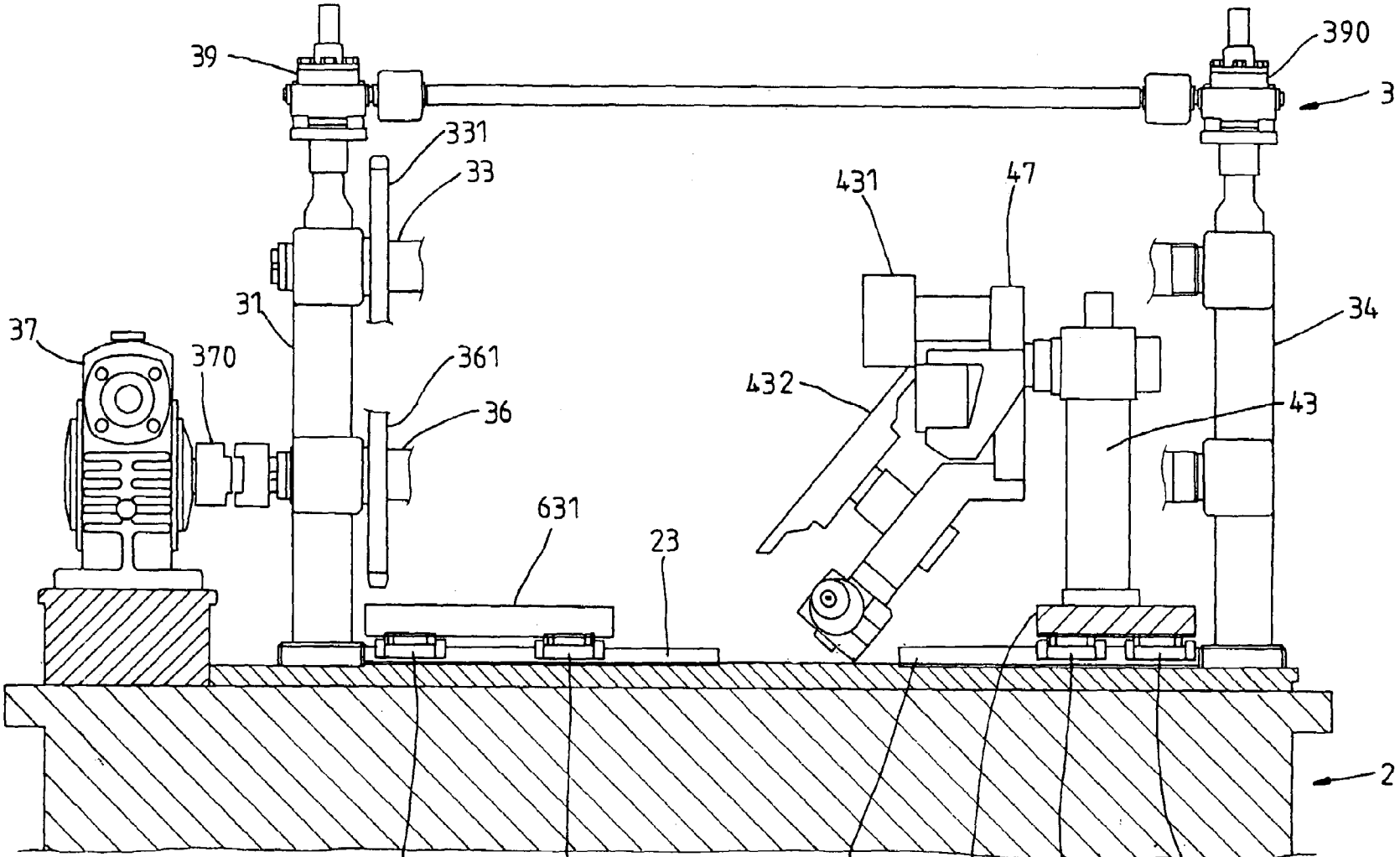
FIG. 8 is a schematic sectional view of still another part of the roll-forming machine according to the present invention.
Figure 10:
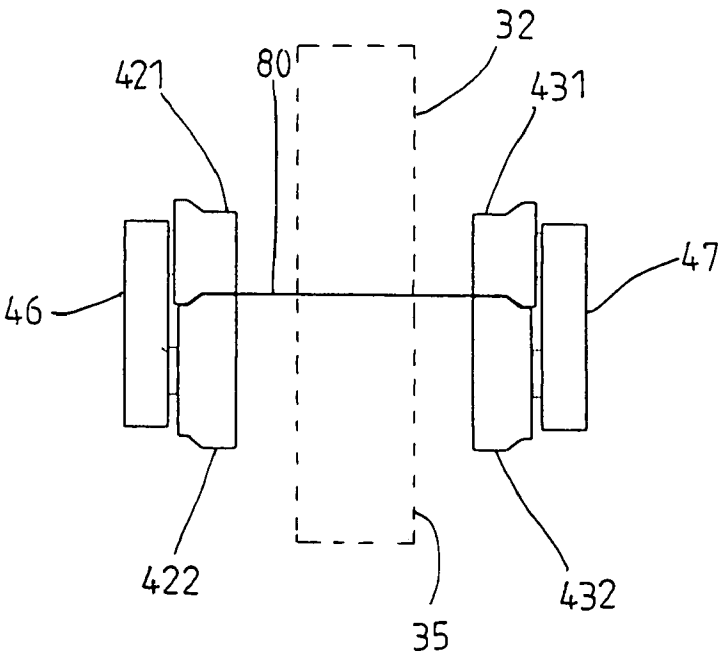
FIG. 10 is a schematic plain view showing the sheet material rammed by another set of forming rolls according to the present invention.
Figure 9:
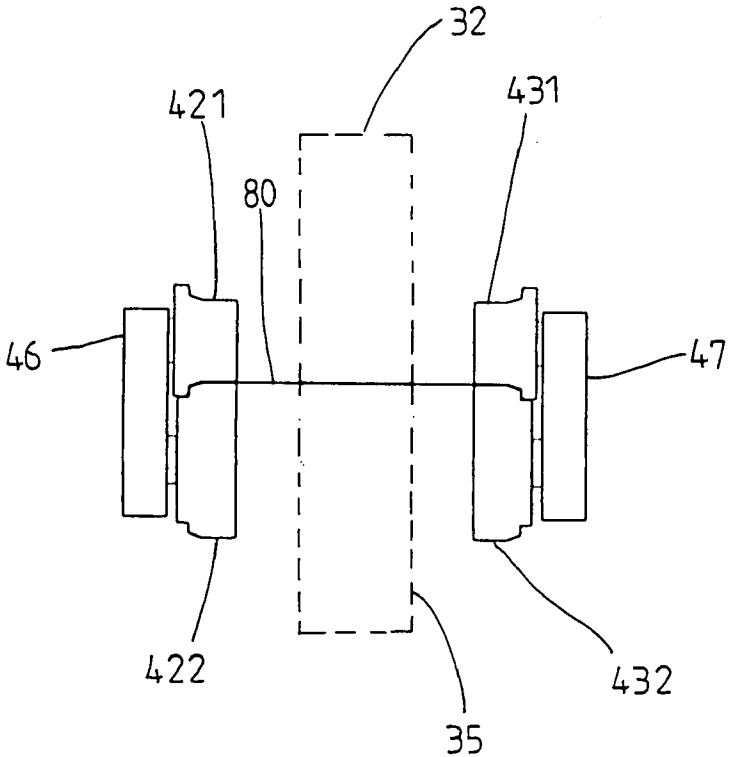
FIG. 9 is a schematic plain view showing the sheet material rammed by one set of forming rolls according to the present invention.
Figure 12:
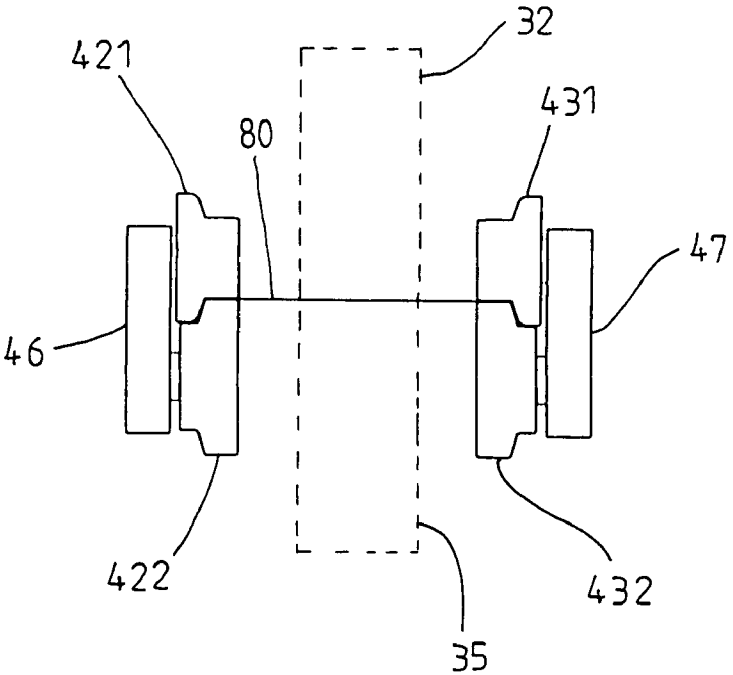
FIG. 12 is a schematic plain view showing the sheet material rammed by still another set of forming rolls according to the present invention.
Figure 11:
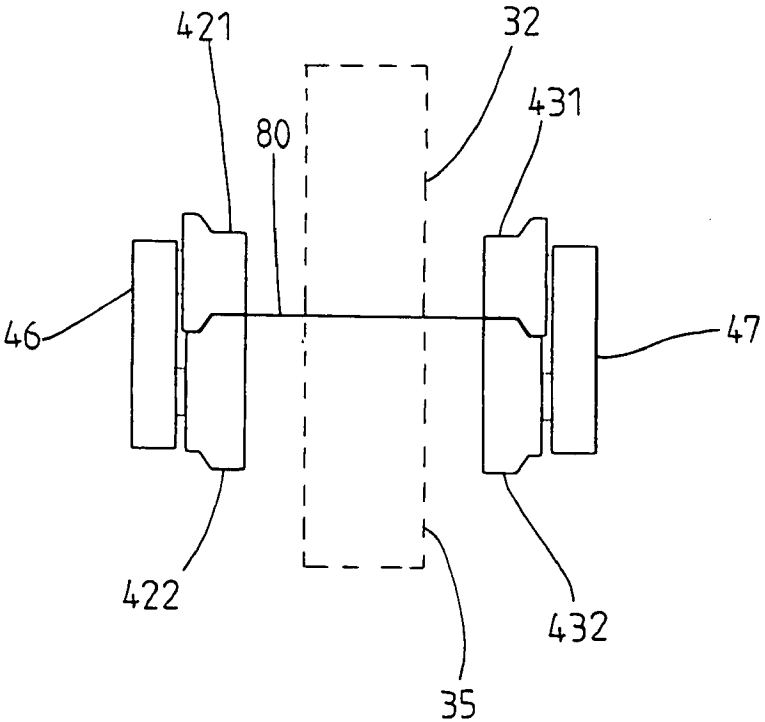
FIG. 11 is a schematic plain view showing the sheet material rammed by still another set of forming rolls according to the present invention.
Figure 14:
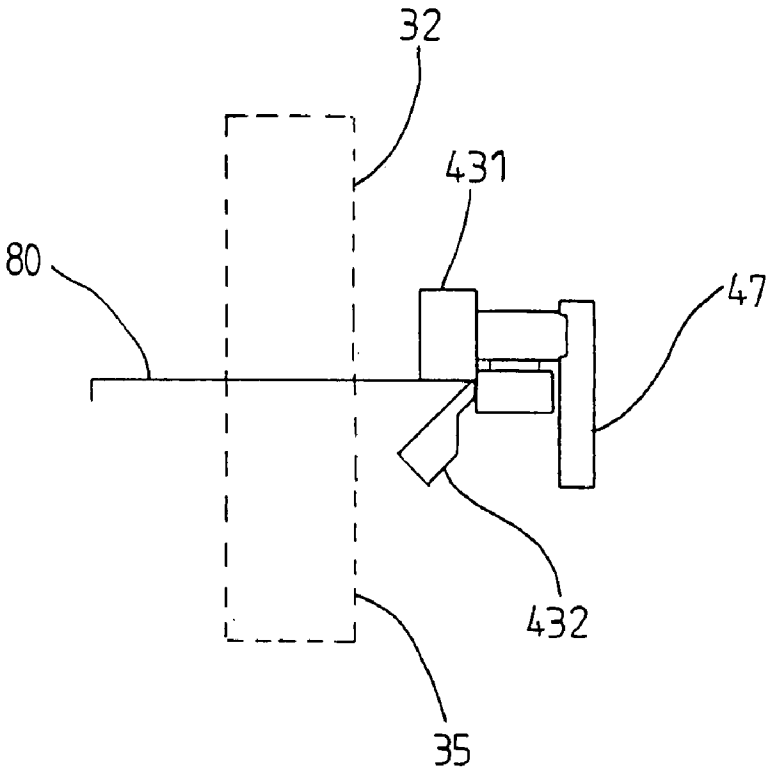
FIG. 14 is a schematic plain view showing the sheet material rammed by still another set of forming rolls according to the present invention.
Figure 13:
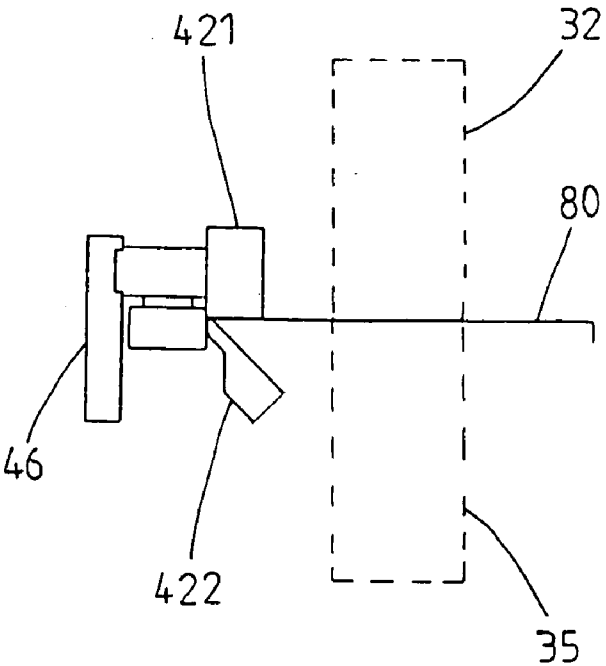
FIG. 13 is a schematic plain view showing the sheet material rammed by still another set of forming rolls according to the present invention.
Figure 16:
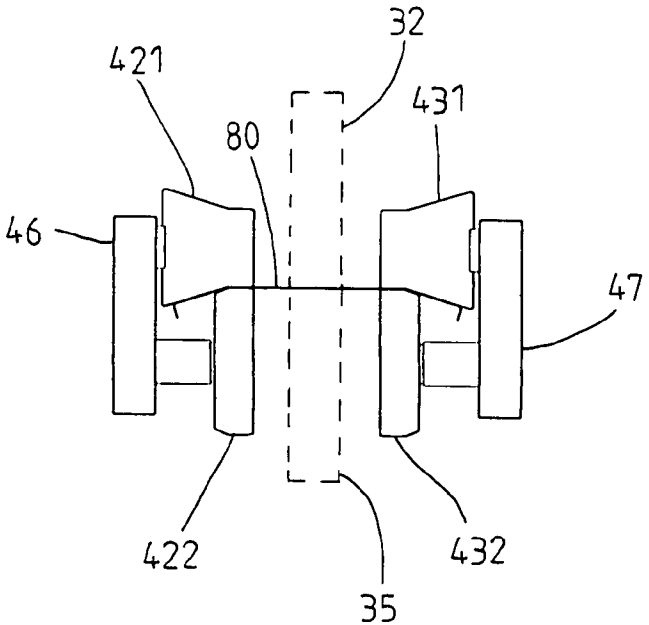
FIG. 16 is a schematic plain view showing the sheet material rammed by still another set of forming rolls according to the present invention.
Figure 15:
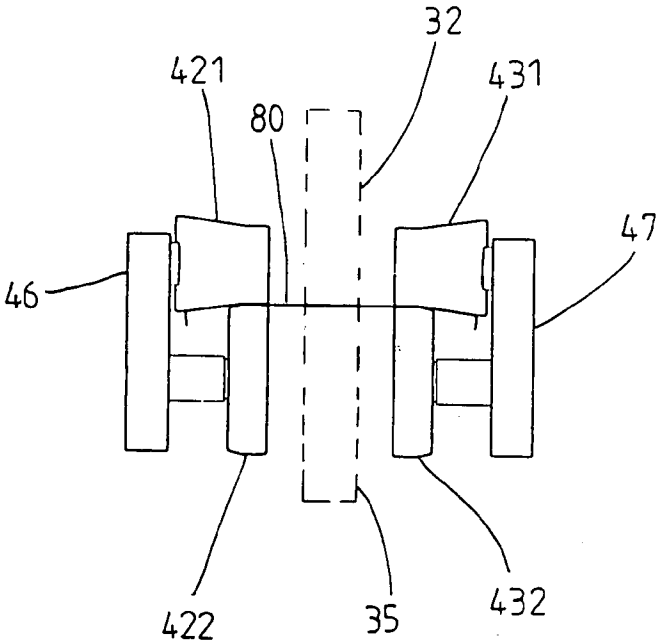
FIG. 15 is a schematic plain view showing the sheet material rammed by still another set of forming rolls according to the present invention.
Figure 18:
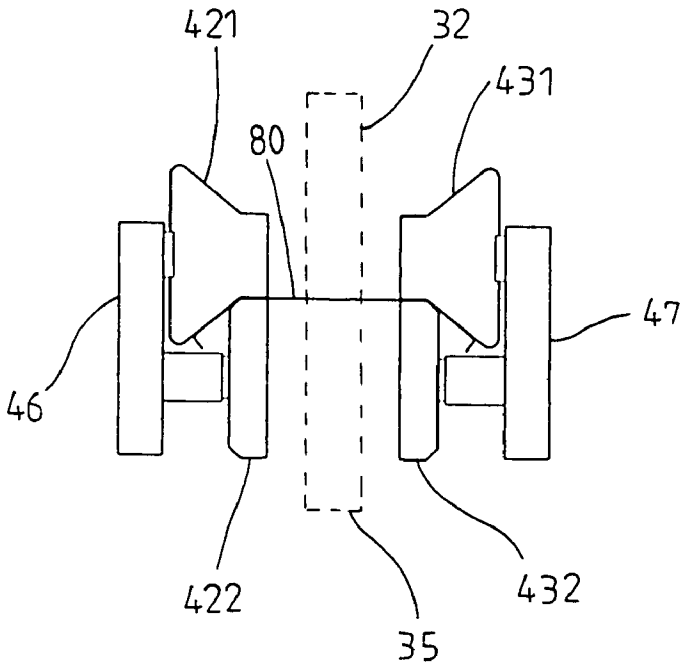
FIG. 18 is a schematic plain view showing the sheet material rammed by still another set of forming rolls according to the present invention.
Figure 17:
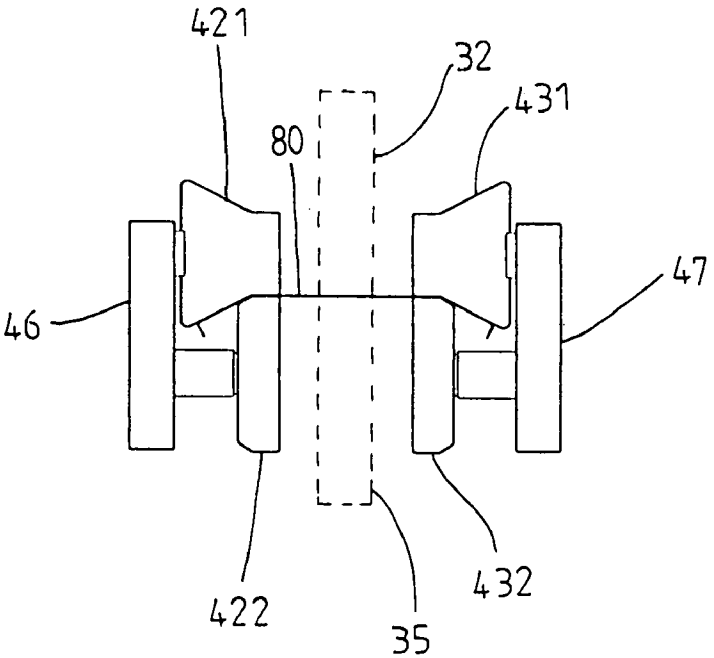
FIG. 17 is a schematic plain view showing the sheet material rammed by still another set of forming rolls according to the present invention.
Figure 20:
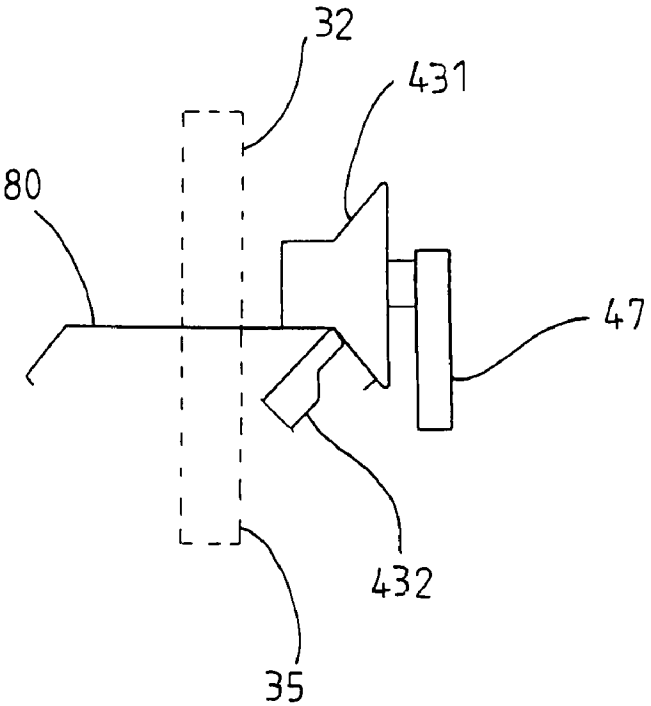
FIG. 20 is a schematic plain view showing the sheet material rammed by still another set of forming rolls according to the present invention.
Figure 19:
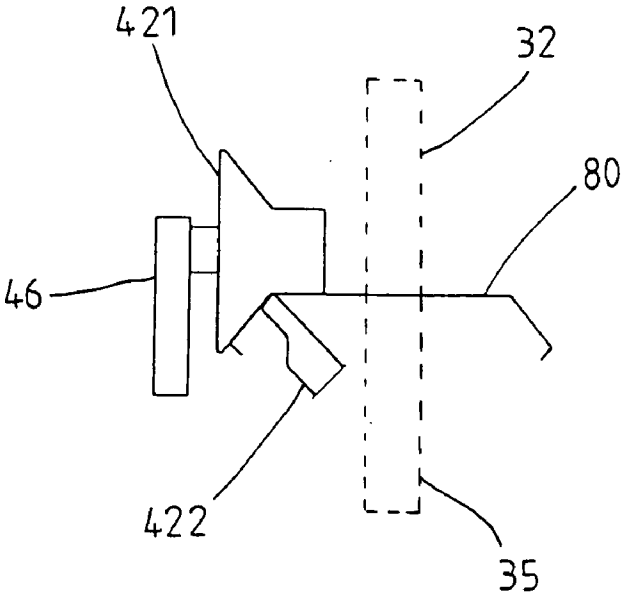
FIG. 19 is a schematic plain view showing the sheet material rammed by still another set of forming rolls according to the present invention.
Figure 22:
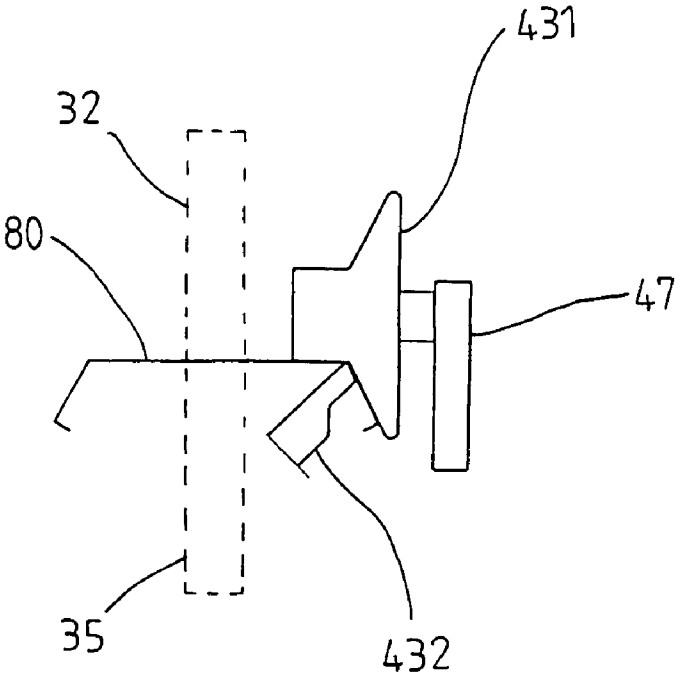
FIG. 22 is a schematic plain view showing the sheet material rammed by still another set of forming rolls according to the present invention.
Figure 21:
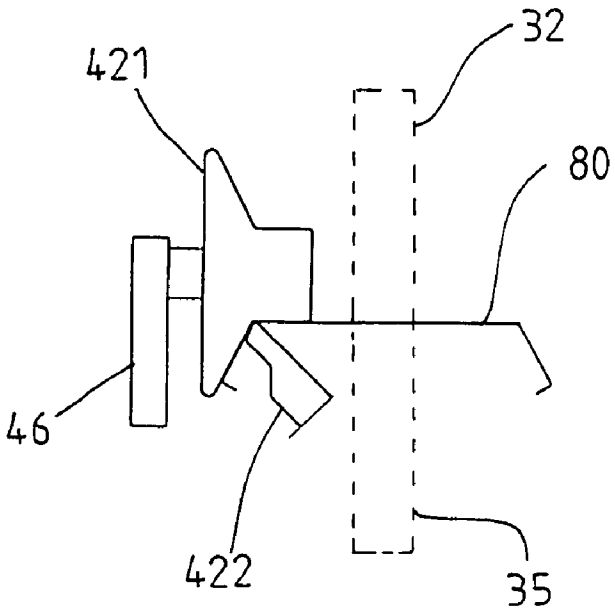
FIG. 21 is a schematic plain view showing the sheet material rammed by still another set of forming rolls according to the present invention.
Figure 24:
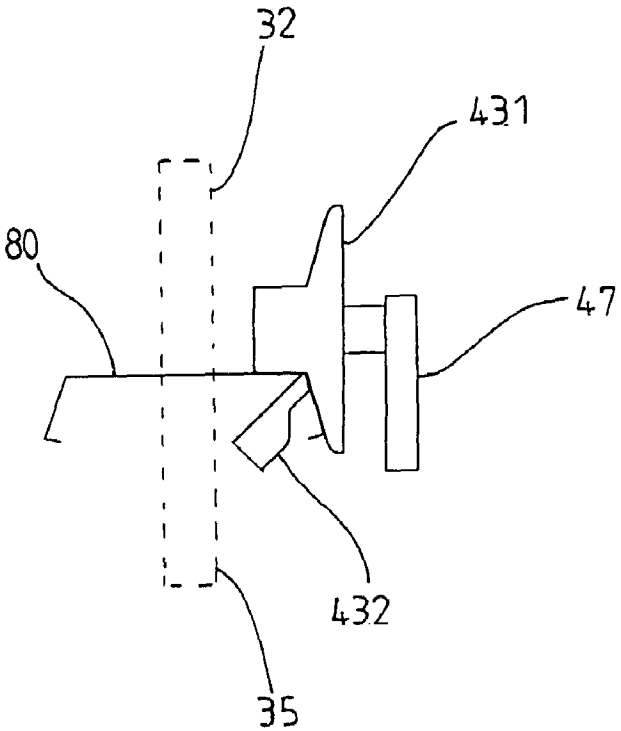
FIG. 24 is a schematic plain view showing the sheet material rammed by still another set of forming rolls according to the present invention.
Figure 23:
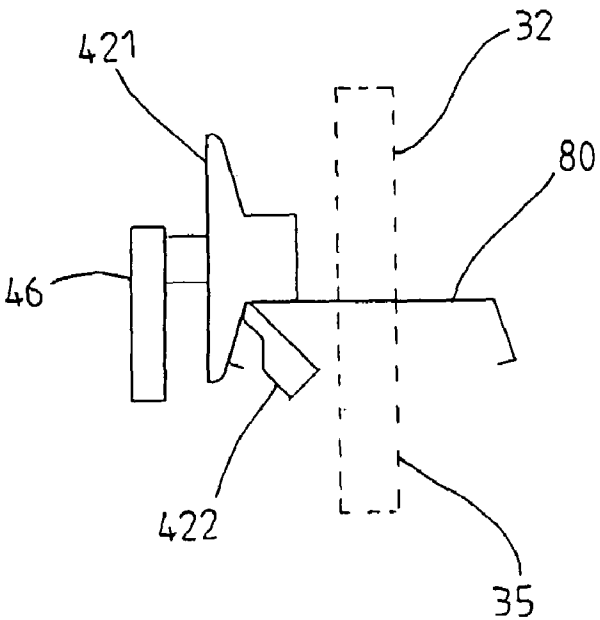
FIG. 23 is a schematic plain view showing the sheet material rammed by still another set of forming rolls according to the present invention.
Figure 26:
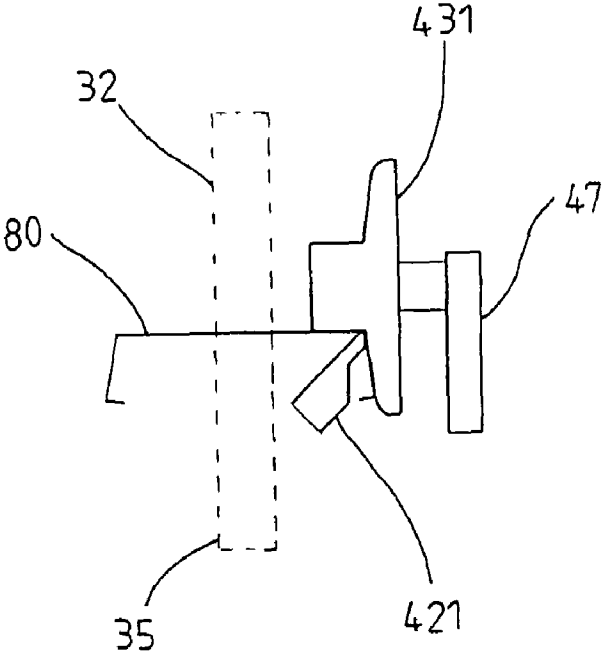
FIG. 26 is a schematic plain view showing the sheet material rammed by still another set of forming rolls according to the present invention.
Figure 25:
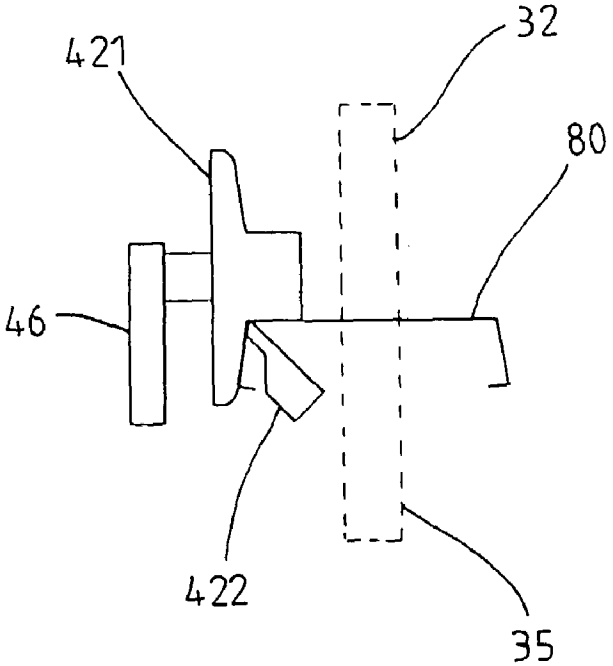
FIG. 25 is a schematic plain view showing the sheet material rammed by still another set of forming rolls according to the present invention.
Figure 28:
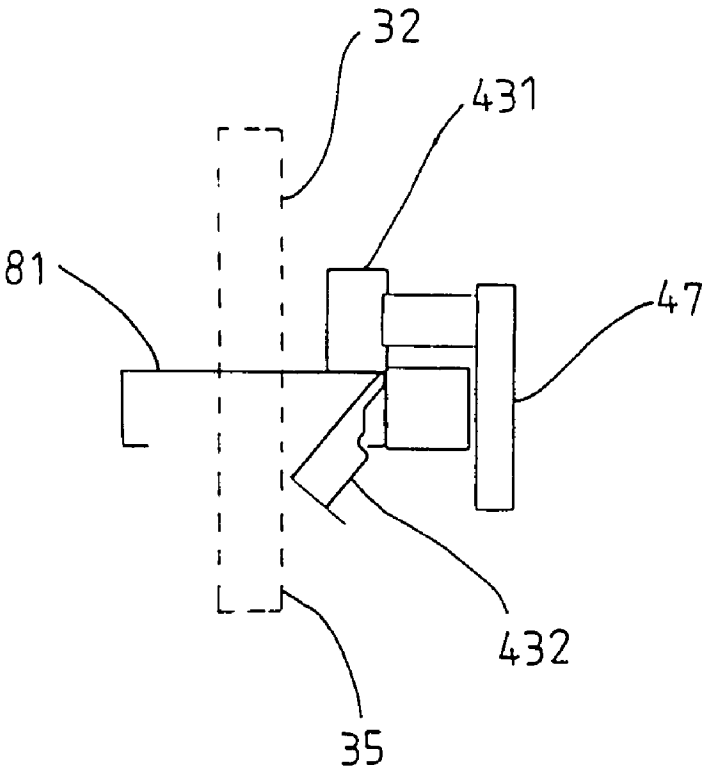
FIG. 28 is a schematic plain view showing the sheet material rammed by the last set of forming rolls into a C-shaped component according to the present invention.
Figure 27:
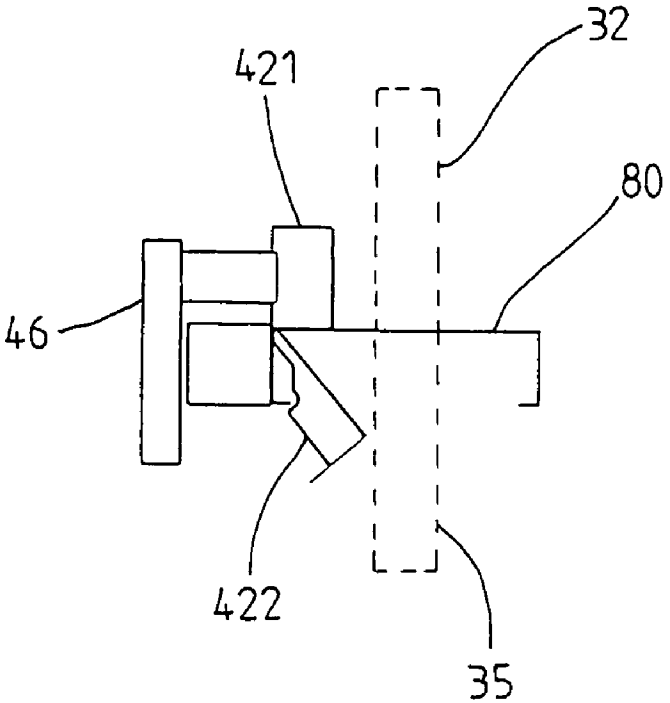
FIG. 27 is a schematic plain view showing the sheet material rammed by still another set of forming rolls according to the present invention.
Figure 29:
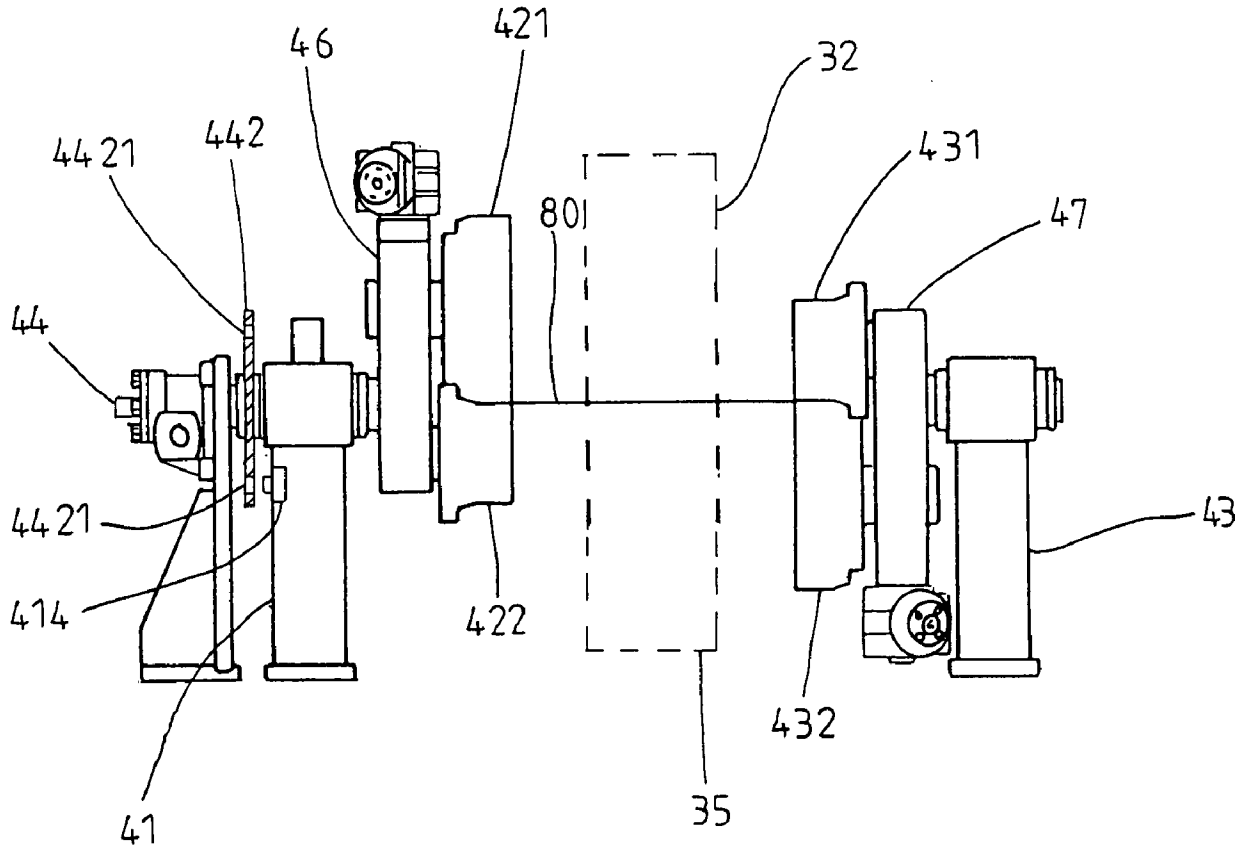
FIG. 29 is a schematic plain view showing the relative position between the first left-side forming roll and the second left-side forming roll reversed according to the present invention.
Figure 30:
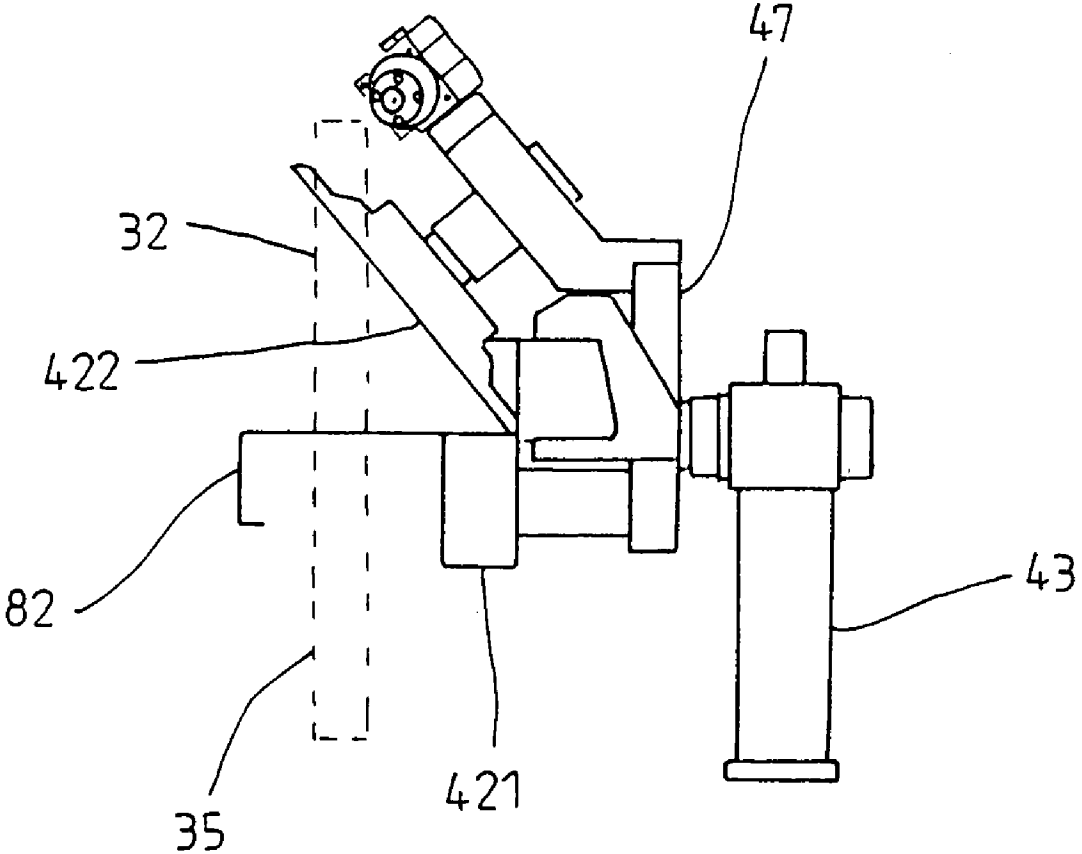
FIG. 30 is a schematic plain view showing a sheet material rolled into a Z-shaped component according to the present invention.
Figure 31:
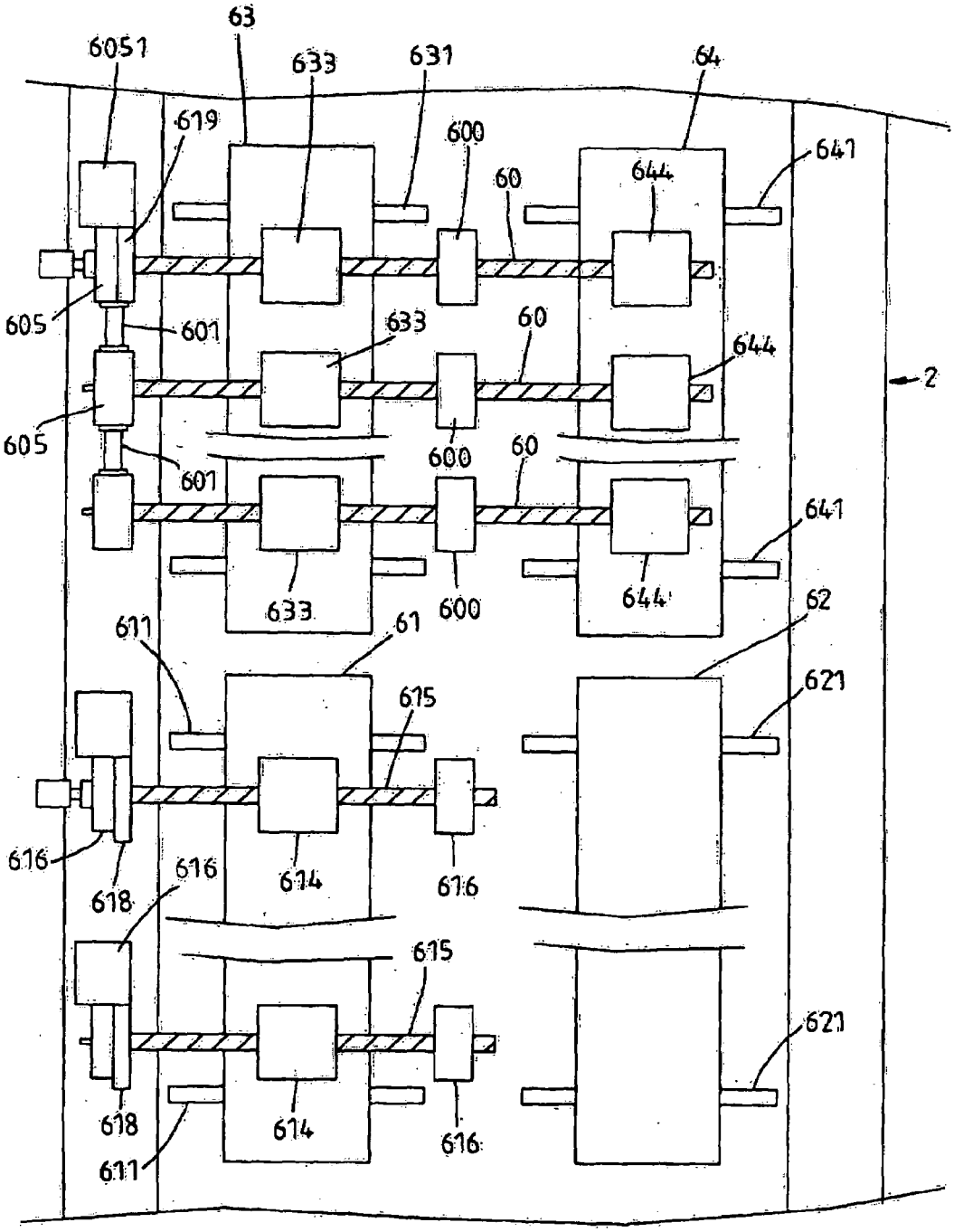
FIG. 31 is a top plain view of a part of the present invention, showing the arrangement of the first left-side bottom plate, the first right-side bottom plate, the second left-side bottom plate, the second right-side bottom plate, and the respective screw rods.

Referring to FIGS. 2~4, the left-side support 31 and right-side support 34 of each sheet-transfer roll set 3 have a respective vertically extending sliding slot 310, 340. Each sheet-transfer roll set 3 further comprises two sliding blocks 332, 333 respectively fixedly fastened to the two distal ends of the first axle 33 of the respective sheet-transfer roll set 3, two vertical screw rods 3321, 3331 respectively vertically mounted in the left-side support 31 and the right-side support 34 and threaded through the sliding blocks 332, 333, and two raisers 39, 390 respectively installed in the left-side support 31 and the right-side support 34 at the top and adapted to rotate the vertical screw rods 3321, 3331 and to further lift or lower the first axle 33 to the desired elevation. The raisers 39 at the left-side supports 31 of the sheet-transfer roll sets 3 have the respective first end coupled to a respective coupling 391 and steering device 392 through a respective coupling 301. Transmission shafts 301 respectively couple the steering devices 392 at the raisers 39 to the steering device 393 by. The raisers 39 at the left-side supports 31 of the sheet-transfer roll sets 3 have the respective second end coupled to one end of a respective transmission shaft 302 through a coupling 394. The transmission shafts 302 have the other end coupled to the raiser 390 the right-side support 34 of the respective sheet-transfer roll set 3 by a coupling 395. Further, the steering device 392 at one side of the raiser 39 at the left-side supports 31 of one of the sheet-transfer roll sets 3 is coupled to a motor 30 (see FIG. 39). When started the motor 30, the steering devices 392 and the transmission shafts 301 are rotated to drive the raisers 39 and the raisers 390, causing the raisers 39, 390 to rotate the vertical screw rods 3321, 3331 and to further lift or lower the first axle 33 to the desired elevation.

A prototype of roll-forming machine has been constructed with the features of FIGS. 2~39. The roll-forming machine functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A roll-forming machine for the formation of a C-shaped component and a Z-shaped component selectively from sheet materials, comprising:

a machine base, said machine base comprising a guide block unit provided at a front side thereof for guiding in a sheet material for processing;

a plurality of sheet-transfer roll sets, each said sheet-transfer roll set comprising a left-side support and a right-side support arranged in parallel, a first axle and a second axle horizontally pivotally connected between said left-side support and said right-side support at different elevations, an impression roll fixedly mounted on said first axle, a sheet-transfer roll fixedly mounted on said second axle in proximity to said impression roll, a first gear wheel fixedly mounted on said first axle, a second gear wheel fixedly mounted on said second axle and meshed with said first gear wheel, a reduction gear box, and a coupling coupled between said reduction gear box and said second axle;

a sheet-transfer roll set driving motor coupled to the reduction gear box of one said sheet-transfer roll set and adapted to drive the reduction gear box of each said sheet-transfer roll set to rotate the second axles of said sheet-transfer roll sets and to further rotate the impression rolls and sheet-transfer rolls of each said sheet-transfer roll set relative to each other in reversed direction to transfer a sheet material; and a plurality of forming roll sets, each said forming roll set comprising a left-side wheel holder, a right-side wheel holder, a first left-side forming roll and a second left-side forming roll pivotally mounted on said left-side wheel holder at different elevations, and a first right-side forming roll and a second right-side forming roll pivotally mounted on said right-side wheel holder at different elevations corresponding to said first left-side forming roll and said second left-side forming roll;

wherein the left-side support and right-side support of each said sheet-transfer roll set are respectively fixedly fastened to said machine base at left and right sides; the left-side wheel holder and right-side wheel holder of each said forming roll set are respectively fastened to a first left-side bottom plate, a first right-side bottom plate, a second left-side bottom plate and a second right-side bottom plate, said first left-side bottom plate and said first right-side bottom plate each having a plurality of sliding blocks provided at a bottom side and respectively coupled to a first left-side rail and a first right-side rail at said machine base, said second left-side bottom plate and said second right-side bottom plate each having a plurality of sliding blocks provided at a bottom side thereof and respectively coupled to a second left-side rail and a second right-side rail at said machine base, wherein a pivot shaft at the left-side wheel holder of each said forming roll set has an outer end connected to a steering device, which is mounted on an upright at the first left-side bottom plate of the respective forming roll set, the steering devices of said forming roll sets being coupled to transmission shafts and then a motor by couplings for enabling the motor to rotate the transmission shafts and the couplings and to further drive the pivot shaft at the left-side wheel holder of each said forming roll set to turn wheel brackets at the left-side wheel holders of the forming roll sets through 180°, for selectively enabling the forming rolls of said forming roll set to roll a sheet material into the C-shaped component or the Z-shaped component.

2. The roll-forming machine as claimed in claim 1, wherein the left-side wheel holder and right-side wheel holder of each said forming roll set each have a wheel bracket pivotally secured thereto by a respective pivot shaft; the first left-side forming roll and first right-side forming roll of each said forming roll set being respectively pivoted to the wheel brackets of the respective forming roll set, said wheel brackets each having a sliding groove, the second left-side forming roll and second right-side forming roll of each said forming roll set being respectively pivotally mounted on respective sliding blocks that are respectively slidably coupled to the sliding grooves of the wheel brackets of the respective forming roll set; each said forming roll set further comprises two screw rods respectively threaded through the wheel brackets thereof, and two speed-reduction motors adapted to rotate the respective screw rods and to further move the respective sliding blocks vertically along the sliding grooves of the respective wheel brackets, so as adjust the pitch between the respective first left-side forming roll and the respective second right-side forming roll and the pitch between the respective first right-side forming roll and the respective second right-side forming roll.

3. The roll-forming machine as claimed in claim 1, further comprising a detection wheel fastened to the pivot shaft at the left-side wheel holder of one said forming roll set, said detection wheel having a plurality of through holes equiangularly spaced around the border area thereof, and a photo sensor module installed in the left-side wheel holder which supports said detection wheel, said photo sensor module being adapted to emit light toward the through holes of said detection wheel so as to measure the amount of rotation of said detection wheel and to control the turning angle of the motor, which is adapted to turn the wheel brackets at the left-side wheel holders of said forming roll sets through 180°.

4. The roll-forming machine as claimed in claim 1, wherein the motor of each said sheet-transfer roll set is mounted on said machine base near one lateral side and connected to the reduction gear boxes of said sheet-transfer roll sets by transmission shafts and couplings and adapted to drive said reduction gear boxes to rotate the respective second axles through the respective couplings.

5. The roll-forming machine as claimed in claim 1, wherein the first left-side bottom plate that holds the left-side wheel holder of the respective forming roll set comprises a plurality of fixed guide blocks, and a plurality of screw rods respectively threaded through said fixed guide blocks, the screw rods of the first left-side bottom plate each having a first end threaded into a bearing block at said machine base and a second end coupled to a speed reduction motor on a motor mount at said machine base.

6. The roll-forming machine as claimed in claim 1, wherein each said sheet-transfer roll set further comprises a plurality of fixed guide blocks respectively mounted on the second left-side bottom plates and second right-side bottom plates thereof, a plurality of screw rods respectively threaded through the fixed guide blocks at the second left-side bottom plate and second right-side bottom plate of each said sheet-transfer roll set, the screw rods at the fixed guide blocks of said sheet-transfer roll sets each having a first end threaded into a respective bearing block at said machine base and a second end coupled to a respective steering device on a support at said machine base; the steering devices of said sheet-transfer roll sets are respectively connected to one another by transmission shafts; a motor is coupled to one steering device of one said sheet-transfer roll set for driving the steering devices of said sheet-transfer roll sets to rotate the respective transmission shafts and the respective screw rods and to further move the second left-side bottom plates of said sheet-transfer roll sets relative to the respective second right-side bottom plates.

7. The roll-forming machine as claimed in claim 1, wherein the left-side support and right-side support of each said sheet-transfer roll set each have a vertically extending sliding slot; each said sheet-transfer roll set further comprises two sliding blocks respectively fixedly fastened to two distal ends of the first axle of the respective sheet-transfer roll set, two vertical screw rods respectively vertically mounted in the left-side support and right-side support of the respective sheet-transfer roll set and threaded through said sliding blocks, and two raisers respectively installed in the left-side support and right-side support of the respective sheet-transfer roll set at the and adapted to rotate said vertical screw rods and to further lift/lower said first axle to the desired elevation, the raisers at the left-side supports of said sheet-transfer roll sets having a first end coupled to a respective steering device through a respective coupling and a second end coupled to the raiser the right-side support of the respective sheet-transfer roll set through a transmission shaft and couplings, the steering devices at the raisers at the left-side supports of said sheet-transfer roll sets being respectively coupled to one another by transmission shafts; the steering device at one side of the raiser at the left-side supports of one said sheet-transfer roll set being coupled to a motor, which is adapted to rotate the steering devices and the transmission shafts at said sheet-transfer roll sets and to further drive the respective vertical screw rods to move the first axles of said sheet-transfer roll sets to the desired elevation.

* * * * *